US006353287B1

(12) United States Patent
Sasaki et al.

(10) Patent No.: US 6,353,287 B1
(45) Date of Patent: Mar. 5, 2002

(54) GASEOUS DISCHARGE PANEL AND MANUFACTURING METHOD THEREFOR

(75) Inventors: Yoshiki Sasaki, Katano; Ryuichi Murai, Toyonaka; Hiroyoshi Tanaka, Kyoto; Hideaki Yasui; Masatoshi Kudoh, both of Hirakata; Akira Shiokawa, Osaka; Junichi Hibino, Neyagawa; Hidetaka Higashino, Kyoto; Kinzo Nonomura, Ikoma; Shigeo Suzuki, Hirakata; Masaki Aoki, Minoo, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/331,139

(22) PCT Filed: Dec. 12, 1997

(86) PCT No.: PCT/JP97/04598

§ 371 Date: Jun. 16, 1999

§ 102(e) Date: Jun. 16, 1999

(87) PCT Pub. No.: WO98/27571

PCT Pub. Date: Jun. 25, 1998

(30) Foreign Application Priority Data

| | | |
|---|---|---|
| Dec. 16, 1996 | (JP) | 8-335563 |
| Mar. 4, 1997 | (JP) | 9-049006 |
| Aug. 19, 1997 | (JP) | 9-222212 |
| Oct. 15, 1997 | (JP) | 9-281716 |
| Nov. 17, 1997 | (JP) | 9-314938 |

(51) Int. Cl.[7] ..... H01J 11/02; H01J 9/02
(52) U.S. Cl. ..... 313/582; 313/570
(58) Field of Search ..... 313/582, 570, 313/584, 587

(56) References Cited

U.S. PATENT DOCUMENTS

| | | | | |
|---|---|---|---|---|
| 5,385,499 A | | 1/1995 | Ogawa et al. | |
| 5,742,122 A | * | 4/1998 | Amemiya et al. | 313/585 X |
| 5,754,003 A | | 5/1998 | Murai et al. | |
| 6,097,149 A | * | 8/2000 | Miyaji et al. | 313/582 |

FOREIGN PATENT DOCUMENTS

| | | | | |
|---|---|---|---|---|
| EP | 616354 | | 9/1994 | |
| JP | 50-100967 | | 8/1975 | |
| JP | 50-159247 | | 12/1975 | |
| JP | 53-27360 | | 3/1978 | |
| JP | 54-158859 | | 12/1979 | |
| JP | 60-64659 | | 4/1985 | |
| JP | 008044 | * | 4/1988 | 313/582 |
| JP | 1-113948 | | 7/1989 | |
| JP | 2-242548 | | 9/1990 | |
| JP | 3-254041 | | 11/1991 | |
| JP | 8-171863 | | 7/1996 | |
| JP | 8-185802 | | 7/1996 | |
| JP | 8-507645 | | 8/1996 | |
| WO | 94/28570 | | 12/1994 | |

* cited by examiner

*Primary Examiner*—Ashok Patel
(74) *Attorney, Agent, or Firm*—Ratner & Prestia

(57) ABSTRACT

Plasma display panels of the prior art are prone to cross talk leading to unstable image. The present invention provides a gas discharge panel comprising a first panel substrate 104 having first electrodes 24, a second panel substrate 108 having second electrodes 23 opposing the first panel substrate 104, a sealing portion provided between peripheries of the two substrates for forming a gas discharge space 112 between the first and second panel substrates 104, 108 and division walls 30 provided on the second panel substrate 108 for dividing the gas discharge space 112, wherein ridges of the division walls 30 are bonded onto the inner surface of the first panel substrate 104 by a frit glass 31.

16 Claims, 18 Drawing Sheets

GASEOUS DISCHARGE PANEL AND MANUFACTURING METHOD THEREFOR

This application is a 373 of PCT International Application No. PCT/JP97/04598.

FIELD OF THE INDUSTRIAL UTILIZATION

The present invention relates to a gas discharge panel and a method for manufacturing the same.

BACKGROUND OF THE INVENTION

An AC type plasma display panel (hereinafter called the PDP) as shown in FIG. 7 has been known as an example of gas discharge panel.

Panel configuration and operation of the conventional PDP will be described below with reference to the accompanying drawing.

FIG. 20 is a perspective sectional view schematically showing the PDP of the prior art.

In this drawing, reference numeral 4 denotes a front substrate (also called the upper panel substrate), and 8 denotes a back substrate (also called the lower panel substrate). An outer casing 10 has such a configuration that the front substrate 4 and the back substrate 8 are disposed to oppose each other with the gap between the peripheries thereof being filled with a sealing member 9 (refer to FIG. 21) made of glass having a low melting point thereby to form a gas discharge space which is sealed to be airtight and is filled with a rare gas (a mixture of helium and xenon gases) with a pressure from 300 to 500 Torr.

The front substrate 4 comprises a front panel glass 201, display electrodes 1 formed in a pattern on the front panel glass 201, a dielectric film 2 formed to cover the display electrodes 1 and an MgO protective film 3 formed on the dielectric film 2.

The back substrate 8 comprises a back panel glass 202, address electrodes 5 (also called the data electrode) formed in a pattern on the surface of the back panel glass 202, a dielectric film 6 formed to cover the address electrodes, division walls 7 comprising a plurality of ribs, and RGB fluorescent substances 11*a* through 11*c* applied between the ribs. The division wall 7 is means for dividing the gas discharge space. Compartment 12 thus divided serve as light emitting regions, while the fluorescent substance 11 is coated separately in each of these light emitting regions. The ribs of the division walls 7 and the address electrodes 5 are formed in parallel with each other and the display electrodes 1 and the address electrodes 5 cross at right angles with each other.

In the casing 10 configured as described above, when voltages are applied to the address electrodes 5 and the display electrodes 1 at a proper timing, discharge occurs in the compartment 12 divided by the division walls 7 corresponding to display pixels so that ultraviolet rays are emitted and excite the RGB fluorescent substances 11*a* through 11*c* that in turn emit visible light which constitutes an image.

The front panel glass and the back panel glass are sealed to form a space delimited thereby that is filled with the discharge gas. Because pressure of the discharge gas filling the space is usually lower than the atmospheric pressure, however, the front panel glass and the back panel glass are pressed inward by the atmospheric pressure so that ridges of the division walls 7, or top portions of the ribs, make contact with the inner surface of the front panel glass 201, thereby keeping the clearance between the front panel glass 201 and the back panel glass 202. As a consequence, it is not necessary to bond the ridges of the division walls 7 and the inner surface of the front panel glass 201, which are merely brought into contact with each other.

Now a method for manufacturing the PDP of the prior art will be described below with reference to the accompanying drawings.

FIG. 21 is a partially cutaway perspective view schematically showing the same PDP of the prior art as shown in FIG. 20.

As shown in FIG. 21, the front substrate 4 is made by forming the electrodes 1 on the glass substrate 201, forming the dielectric film 2 to cover the electrodes 1, firing the dielectric film 2 and forming the protective film (MgO) 3 thereon by EB vapor deposition.

As for the back substrate 8, the electrodes 5 are s formed on a glass substrate 202 and is then covered the dielectric film 6 formed thereon and fired. Then after forming a layer of a material to make the division walls all over the surface by printing process, the division wall material is removed by sand blast from portions where the division wall is not to be formed thereby to form the division walls 7 in linear configuration through a firing process. Then the space between the ribs of the division walls 7 is filled with the fluorescent substance 11 by a printing process or the like, dried and fired to complete the back substrate 8.

The front substrate 4 and the back substrate 8 completed as described above are fired after applying glass of low melting point that makes the sealing member 9 to the peripheries thereof, thereby sealing the space therebetween. After evacuating the inner space through a chip tube (also called the piping member) 13, the space is filled with a rare gas and the tube is chipped off, thereby completing the PDP.

Operations of filling the inner space with the rare gas using the chip tube 13 and chipping off will be described in more detail below with reference to FIGS. 21, 22.

As shown in FIG. 21, when manufacturing the PDP (container filled with the gas) of the prior art, the lower panel substrate 8 is fitted on an external position thereof with the piping member 13 that communicates with the gas discharge space in the casing 10 via a through hole 8a formed in the lower panel substrate 8. Then after purging the air from the inside of the casing (the container before being filled with the gas) 10 and filling the inner space with the discharge gas, the piping member 13 is closed thereby sealing the inner space of the casing 10.

Closing of the piping member 13 is carried out as shown in FIG. 22(*a*) by heating and melting the closing portion 13*a* of the piping member 13 with a gas burner 14 or the like applied from the outside. After causing the piping member 13 to contract by moving the lower portion of the closing portion 13*a* which has melted away from the casing 10 as shown in FIG. 22(*b*), the piping member 13 is cut off by melting as shown in FIG. 22(*c*). Thus in the prior art, since the atmospheric pressure is higher than the inner pressure of the casing 10, the closing portion 13*a* of the piping member 13 which has contracted is completely closed due to contraction of the inner wall of the piping.

The lower panel substrate 8 bears the piping member 13, that was used when purging air from the inner space of the casing 10 and filling it with the discharge gas, remaining thereon as bonded by using the same material as the sealing member 9.

In the PDP configuration of the prior art as described above, however, the front substrate 4 and the back substrate 8 are bonded to each other on the peripheries thereof by frit glass (sealing member 9) used for sealing but mostly secured by the differential pressure between the atmospheric pressure acting thereon from the outside and the inner pressure which is below one atmosphere of the gas filing the space between the front substrate and the back substrate, that causes the front substrate to be pressed against the division walls thereby to maintain the configuration.

Pressure of the filling gas is generally from 300 Torr to 500 Torr, which is not significantly different from the atmospheric pressure of 760 Torr.

As a consequence, there has been such a problem that, when the PDP of the prior art is used onboard an airplane, for example, such a flight condition as the pressure in the airplane drops significantly below the normal atmospheric pressure causes the inner surface of the front substrate comes off the ridges of the division walls at the middle of the PDP, thus resulting in cross talk.

Even at the normal atmospheric pressure, there has been such a problem that, when the PDP is subject to vibration, the front substrate temporarily comes off the division walls thus resulting in cross talk leading to disturbed image.

Thus the PDP of the prior art configuration has problems such as the displayed image is disturbed due to vibration when used onboard vehicles such as trains and buses.

Moreover, manufacture of the PDP of the prior art involves many firing processes that require a significant number of electric furnaces, leading to high energy cost and making it difficult to achieve energy-efficient production.

The PDP of the prior art configuration has also such a problem that satisfactory brightness cannot necessarily be achieved. In order to improve the brightness, it is believed that the inner pressure of the discharge gas filing the inside of the casing 10 must be increased to a level above 500 Torr.

In the prior art configuration, however, increasing the inner pressure of the discharge gas filing the inside of the casing 10 to a level of about 760 Torr to 1000 Torr causes a gap to be generated between the ridges of the division walls 7 formed on the lower panel substrate 8 and the upper panel substrate 4, or the upper panel substrate 4 and the lower panel substrate 8 to swell outwardly.

As a consequence, there has been such a problem that isolation of the adjacent compartments 12 divided by the ribs of the division walls 7 is broken by the gap, resulting in deterioration in the quality of display by the PDP such as cross talk. Also in case the inner pressure of the discharge gas filling the inside of the casing 10 is near equal to or above the atmospheric pressure, the sealing method that makes use of the atmospheric pressure which is higher than the filling gas pressure as described in conjunction with the conventional manufacturing method can no longer be employed.

DISCLOSURE OF THE INVENTION

An object of the present invention is to solve the problems of the plasma display panel of the prior art described above and provide a gas discharge panel that is less prone to cross talk and is capable of producing more stable image than the prior art, and a method for manufacturing the same.

Another object of the present invention is to solve the problems of the method for manufacturing the plasma display panel of the prior art described above, and provide a method for manufacturing a gas discharge panel that is capable of reducing the number of firing processes over the prior art.

Another object of the present invention is to solve the problems of the plasma display panel of the prior art described above and provide a gas discharge panel that is capable of achieving higher brightness than the prior art, and a method for manufacturing the same.

One aspect of the present invention is a gas discharge panel comprising:

a first panel substrate having first electrodes;

a second panel substrate having second electrodes and opposing said first panel substrate;

a sealing portion provided between peripheries of the two substrates for forming a gas discharge space between said first and second panel substrates; and division walls provided on said second panel substrate for dividing said gas discharge space, wherein ridges of said division walls are bonded onto the inner surface of said first panel substrate.

Another aspect of the present invention is a gas discharge panel wherein the bonding member used in the bonding process includes a light-transmitting material.

Still another aspect of the present invention 3 is a gas discharge panel wherein the bonding member used in the bonding process includes a light-absorbing material, and the material for making said division wall includes a light-reflecting material.

Yet another aspect of the present invention is a gas discharge panel wherein the width of bonding portion between the ridge of said division wall and said first panel substrate is controlled so that the bonding portion does not intrude into a light emitting region in the divided gas discharge space.

Still yet another aspect of the present invention is a gas discharge panel wherein the bonding member used in the bonding process includes fusible glass.

A further aspect of the present invention is a gas discharge panel wherein the softening point of said bonding member is lower than the softening point of said division walls.

A still further aspect of the present invention is a gas discharge panel wherein difference in the softening point of said bonding member and said division walls is not lower than 20° C. and not higher than 200° C.

A yet further aspect of the present invention is a gas discharge panel wherein said division walls have holes on the ridges thereof and said bonding members infiltrates the holes.

A still yet further aspect of the present invention is a gas discharge panel wherein said division walls are formed by thermal spray process.

One aspect of the present invention is a gas discharge panel wherein at least one of the ridge surface of said division walls and portions of the inner surface of said first panel substrate bonded to the ridges has irregular shape.

Another aspect of the present invention is a gas discharge panel wherein all or a part of the ridges of said division walls are bonded onto the inner surface of said first panel substrate.

Still another aspect of the present invention is a gas discharge panel wherein said division walls are a plurality of long plate-shaped ribs disposed in parallel to each other, and the bonding is achieved by using bonding members formed linearly in a direction substantially at right angles with the longitudinal direction of said ribs.

Yet another aspect of the present invention is a gas discharge panel wherein said bonding member includes a light-absorbing material.

Still yet another aspect of the present invention is a gas discharge panel wherein notation that part of the ridges of said division walls are bonded onto the inner surface of said first panel substrate means that said bonding is provided in the vicinity of said first electrode in the ridges of said division walls.

A further aspects of the present invention is a gas discharge panel wherein the ridges of said division walls have recesses formed thereon, and said bonding is achieved by using said recesses.

A still further aspect of the present invention is a gas discharge panel wherein said division walls and said second panel substrate are bonded by using frit glass.

A yet further aspect of the present invention is a gas discharge panel wherein said gas discharge space is filled with the discharge gas with a pressure exceeding 500 Torr.

A still further aspect of the present invention is a method for manufacturing a gas discharge panel comprising:

a first panel substrate having first electrodes;

a second panel substrate having second electrodes and opposing said first panel substrate;

a sealing portion provided between peripheries of the two substrates for forming a gas discharge space between said first and second panel substrates; and division walls provided on said second panel substrate for dividing said gas discharge space, wherein the manufacturing method comprises:

a process of applying bonding members, that is used for bonding the ridges of said division walls and said first panel substrate, to the ridges of said division walls or to the inner surface of said first panel substrate; and a sealing process of forming said gas discharge space by pressurizing said first panel substrate and/or said second panel substrate that oppose each other so that a pressure is applied at least to the portions where said bonding members are provided.

One aspect of the present invention is a method for manufacturing the gas discharge panel wherein the pressurization is carried out by utilizing the resilience of a spring member.

Another aspect of the present invention is a method for manufacturing the gas discharge panel wherein the pressurization is carried out by utilizing the weight of a plate.

Still another aspect of the present invention is a method for manufacturing the gas discharge panel wherein the pressurization is carried out by interposing a shock absorber between said plate and said panel substrate Yet another aspect of the present invention is a method for manufacturing a gas discharge panel comprising:

a first panel substrate having first electrode;

a second panel substrate having second electrode and opposing said first panel substrate;

a sealing portion provided between peripheries of the two substrates for forming a gas discharge space between said first and second panel substrates; and division walls provided on said second panel substrate for dividing said gas discharge space, wherein the manufacturing method comprises:

an application process where a bonding member that is used for bonding the ridges of the division walls and said front substrate and includes fusible glass, an organic binder and an organic solvent is applied to the ridges of said division walls and/or the inner surface of said first panel substrate; and a heating process of heating the bonding member which has been applied to a temperature not lower than the melting point of the fusible glass.

Still yet another aspect of the present invention is a method for manufacturing the gas discharge panel further comprising:

a temporary firing process provided between said application process and said heating process for heating said bonding member to such an extent as most of the organic binder and of the organic solvent included in the applied bonding member are removed; and an assembly process provided between said temporary firing process and said heating process for assembling said first panel substrate and said second panel substrate into said gas discharge panel by means of said sealing portion.

A further aspect of the present invention is a method for manufacturing a gas discharge panel comprising:

a first panel substrate having first electrodes;

a second panel substrate having second electrodes and opposing said first panel substrate;

a sealing portion provided between peripheries of the two substrates for forming a gas discharge space between said first and second panel substrates; and division walls provided on said second panel substrate for dividing said gas discharge space, wherein the manufacturing method comprises:

a division wall forming process of forming said division walls on said second panel substrate;

a bonding member arranging process where bonding members used for bonding the ridge of the division walls and the first panel substrate are disposed on said ridges, wherein said division wall forming process comprises:

and first process of providing a mask member having a predetermined opening on said panel substrate; and a second process of providing said division wall forming material in said opening, and the bonding member arranging process comprises:

a third process of disposing said bonding member on the ridges of said division walls formed in said second process by using said mask member; and a fourth process of removing the mask member A still further aspect of the present invention is a method for manufacturing the gas discharge panel wherein thermal spray method is employed in said second process and/or said third process.

A yet further aspect of the present invention is a method for manufacturing the gas discharge panel wherein said mask member includes a photosensitive material.

A still yet further aspect of the present invention is a method for manufacturing the gas discharge panel wherein said mask member is a photosensitive resin film.

One aspect of the present invention is a method for manufacturing the gas discharge panel wherein said division wall material includes fusible glass, and firing of said division walls and firing of said bonding member are carried out in the same process.

Another aspect of the present invention is a method for manufacturing a gas discharge panel comprising:

a first panel substrate having first electrodes;

a second panel substrate having second electrodes and opposing said first panel substrate;

a sealing portion provided between peripheries of the two substrates for forming a gas discharge space between said first and second panel substrates; and division walls provided on said second panel substrate for dividing said gas discharge space, wherein the manufacturing method comprises:

a division wall forming process of forming said division walls on said second panel substrate;

an application process of applying fusible glass paste to the ridges of said division walls; and a firing process of firing the fusible glass paste.

Still another aspect of the present invention is a method for manufacturing the gas discharge panel wherein said application process employs screen printing method.

Yet another aspect of the present invention is a method for manufacturing the gas discharge panel wherein a screen mask used in said screen printing method does not have a pattern.

Still yet another aspect of the present invention is a method for manufacturing the gas discharge panel wherein part of said division walls have light reflectivity and said fusible glass paste has light absorbency.

A further aspect of the present invention is a method for manufacturing the gas discharge panel wherein said firing process is a process of bonding the ridges of said division walls and the inner surface of the first panel substrate by using said fusible glass paste.

A still further aspect of the present invention is a method for manufacturing a gas discharge panel comprising:

a first panel substrate having first electrodes;

a second panel substrate having second electrodes and opposing said first panel substrate;

a sealing portion provided between peripheries of the two substrates for forming a gas discharge space between said first and second panel substrates; and division walls provided on said second panel substrate for dividing said gas discharge space, wherein the manufacturing method comprises.:

a process of forming grooves by exposing a photosensitive material provided on said second panel substrate to light; and a thermal spray process of filling the grooves formed in the foregoing process with a dielectric material or frit glass by thermal spray thereby to form said division walls, while coolant gas is caused to flow along the material ejected from a thermal spray nozzle to cool down the second panel substrate in said thermal spray process.

A still further aspect of the present invention is a method for manufacturing the gas discharge panel wherein said gas discharge panel has a dielectric film that covers said second electrodes and the material making said dielectric film and said division walls is alumina.

One aspect of the present invention is a method for manufacturing a gas discharge panel comprising:

a first panel substrate having first electrodes;

a second panel substrate having second electrodes and opposing said first panel substrate;

a sealing portion provided between peripheries of the two substrates for forming a gas discharge space between said first and second panel substrates; and division walls provided on said second panel substrate for dividing said gas discharge space, wherein the manufacturing method comprises:

an assembly process of assembling said first panel substrate and said second panel substrate into said gas discharge panel by means of said sealing portion;

a process of attaching a piping member, that communicates with said gas discharge space via a through hole formed in said first or second panel substrate, to the panel substrate that has the through hole;

a filling process of filling the gas discharge space with the discharge gas by using said piping member; and a sealing process of closing said piping member while setting the pressure surrounding said piping member higher than the inner pressure of the discharge gas that fills the gas discharge space.

Another aspect of the present invention is a method for manufacturing the gas discharge panel wherein said piping member is closed by heating said piping member and pressing said piping member from the outside toward the inside so that the piping member is blocked in the sealing process.

Still another aspect of the present invention is a method for manufacturing the gas discharge panel wherein the piping member is closed by heating said piping member to melt a sealing member housed in the piping member so that the piping member is blocked in the sealing process.

Yet another aspect of the present invention is a method for manufacturing the gas discharge panel wherein the piping member is closed by surrounding said piping member with a tubular member and heating the portion of the piping member surrounded by said tubular member while pressing said piping member along the axial direction of said tubular member so that the portion of said piping member is blocked in the sealing process.

Still yet another aspect of the present invention is a method for manufacturing a gas discharge panel comprising:

a first panel substrate having first electrodes;

a second panel substrate having second electrodes and opposing said first panel substrate;

a sealing portion provided between peripheries of the two substrates for forming a gas discharge space between said first and second panel substrates; and division walls provided on said second panel substrate for dividing said gas discharge space, wherein the manufacturing method comprises:

a process of attaching bonding members used in bonding the ridges of said division walls and said first panel substrate to the ridges of said division walls or to the inner surface of the first panel substrate; and a process of bonding the ridges of said division walls and said first panel substrate by means of said bonding members.

DESCRIPTION OF REFERENCE NUMERALS

1: Display electrode

2, 6: Dielectric film

3: Protective film

4: Upper panel substrate (Front substrate)

5: Address electrode

7: Division wall

8: Lower panel substrate (Back substrate)

10: Casing

11: Fluorescent substance

12: Compartment

13: Piping member

15: Bonding member

19: Sealing member

PREFERRED EMBODIMENTS OF THE INVENTION

Now preferred embodiments of the gas discharge panel and the method for manufacturing the same according to the present invention will be described below with reference to the accompanying drawings.

Embodiment 1

Figure 1:
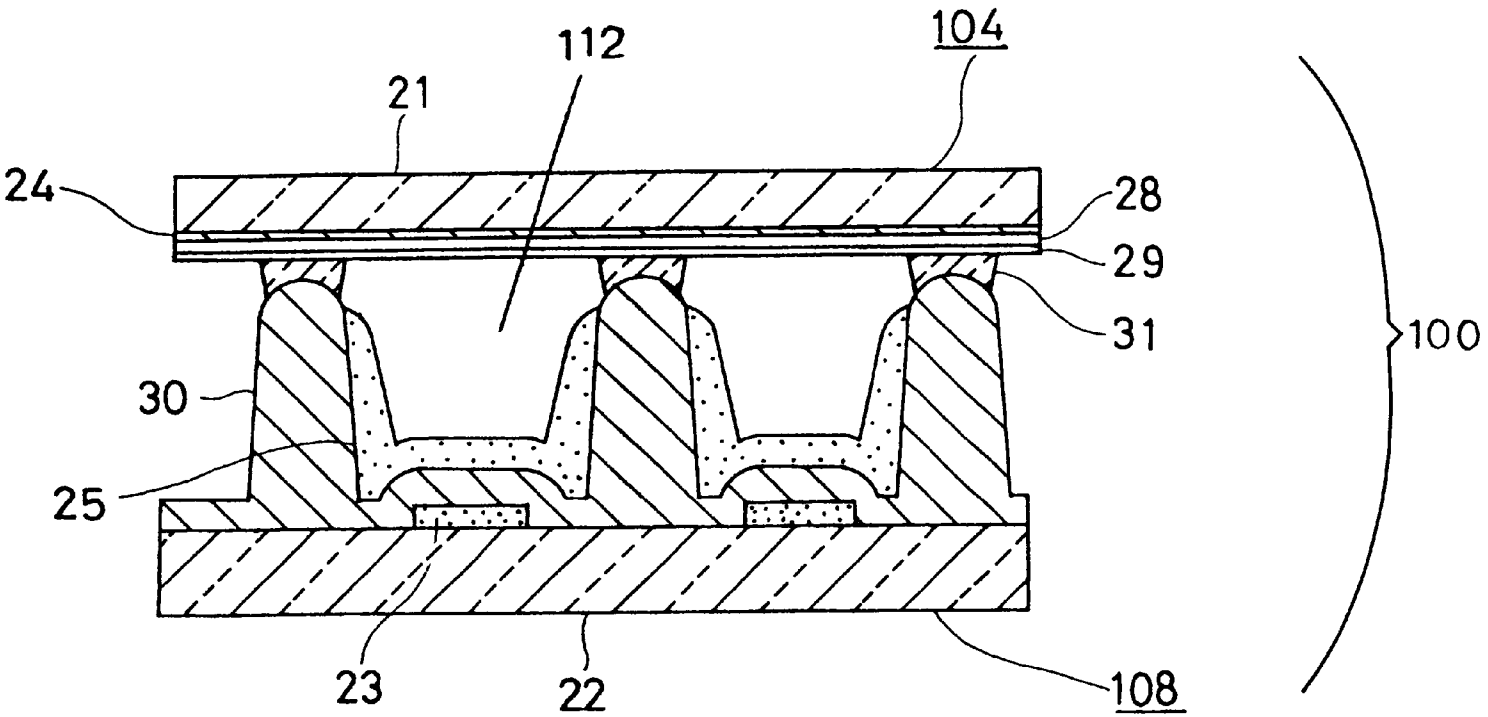
FIG. 1 is a schematic partial sectional view of a plasma display panel according to first embodiment of the present invention.

FIG. 1 is a schematic partial cutaway view of a plasma display panel (PDP) that is an embodiment of the gas discharge panel of the present invention. Reference will be taken to this drawing in the description of the PDP configuration according to this embodiment that follows.

This embodiment is basically the same as the configuration of the PDP of the prior art described above with reference to FIG. 20, except for such points as a frit glass 31 is used as a bonding member of the present invention. Frit glass 31 will be described later.

In FIG. 1, reference numeral 21 denotes a front panel glass and 22 denotes a back panel glass. The front panel glass 21 has display electrodes 24 patterned thereon, with a dielectric film 28 and a protective film 29 being stacked thereon, thereby forming a front substrate 104.

The back substrate 108 comprises the back panel glass 22, address electrodes 23 patterned thereon, division walls 30 and a fluorescent substance 25. The division walls 30 are formed integrally with dielectric films that cover the address electrodes 23, and are formed by thermal spray of alumina in this embodiment. This embodiment is different from the configuration of FIG. 20 also in that the division walls 30 are formed integrally with dielectric films as described above. The division walls 30 comprise a plurality of plate-shaped ribs.

A PDP 100 is made in such a configuration as the front substrate 104 and the back substrate 108 are disposed to oppose each other, with the peripheries thereof being sealed with a sealing member (not shown) made of glass having a low melting point for forming a gas discharge space, while the sealed losed space is filled with a rare gas (mixture of helium gas and xenon gas) with a pressure from 300 Torr to 500 Torr. The division walls 30 are means for dividing the gas discharge space into compartments 112 which act as light emitting regions.

Now the frit glass 31 that characterizes the present invention will be described below.

The frit glass 31 is applied onto the ridges of the division walls 30 in advance in the manufacturing process. Then with the front substrate 104 and the back substrate 108 being disposed to oppose each other and the panel being sealed, the inner surface of the front substrate 104 and the ridges of the division walls 30 are bonded together with the molten frit glass 31.

The division walls 30 have some small holes on the surface thereof. These holes occur when the division walls 30 are formed by thermal spraying. Since the molten frit glass 31 penetrates the holes in the division walls 30, strength of the division walls 30 increases and bonding strength of the two substrates 104, 108 increases.

The division walls 30 and the dielectric film formed integrally with the division walls 30 can be made by printing or other method. The division walls 30 and the dielectric film that lies below thereof may be made of the same material or different materials.

Thus good picture quality with less cross talk or image disturbance can be achieved.

With this configuration, it is also possible to increase the filling gas pressure to the atmospheric pressure or higher, thereby achieving a PDP of high brightness and high efficiency.

Embodiment 2

Figure 2:
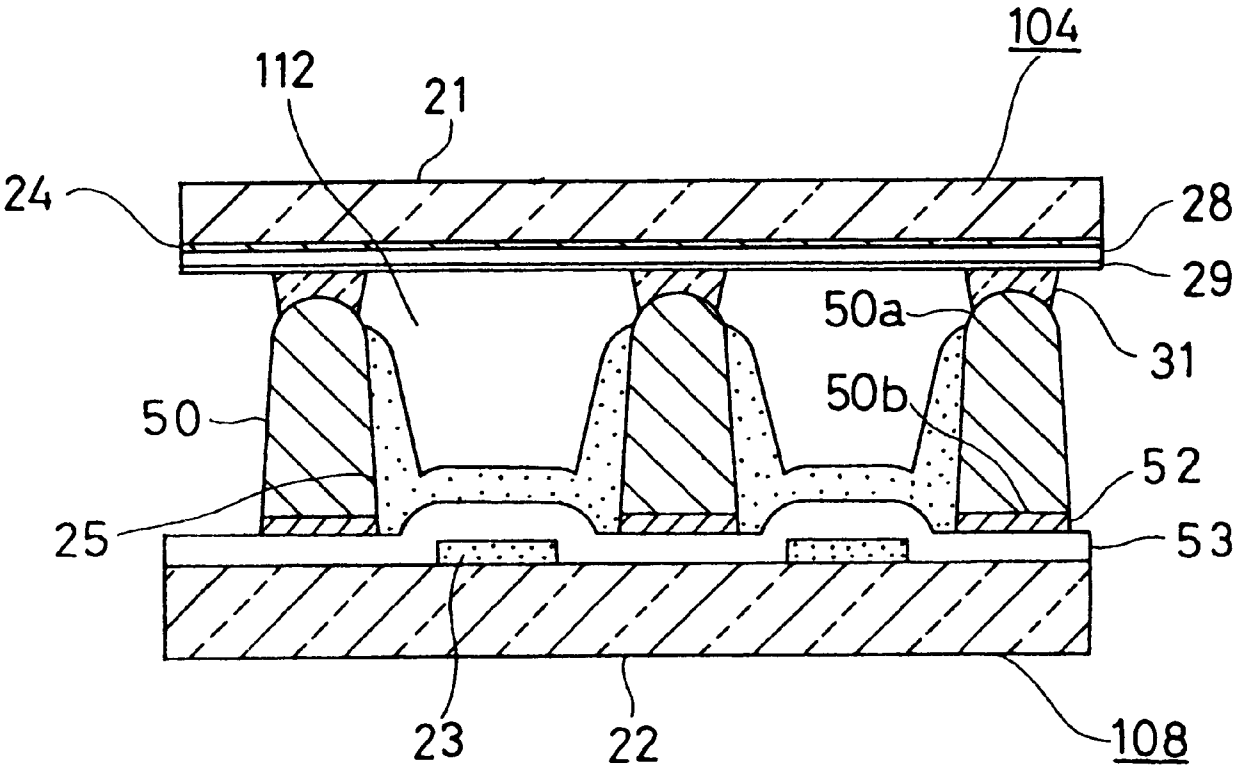
FIG. 2 is a schematic partial sectional view of a plasma display panel according to second embodiment of the present invention.
Figure 3A:
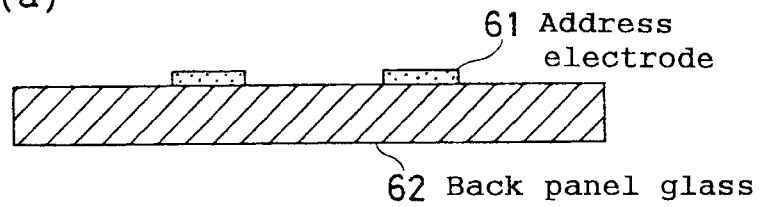
FIGS. 3(*a*) through (*e*) are schematic process diagrams of a method for manufacturing a plasma display panel according to third embodiment of the present invention.
Figure 3B:
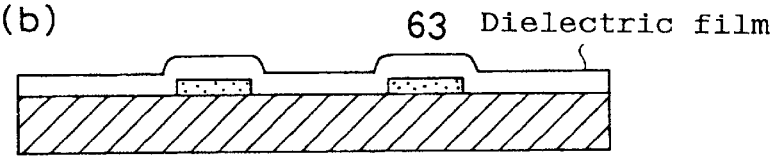
Figure 3C:
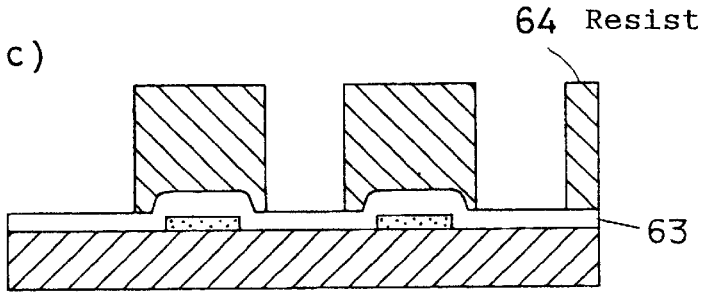
Figure 3D:
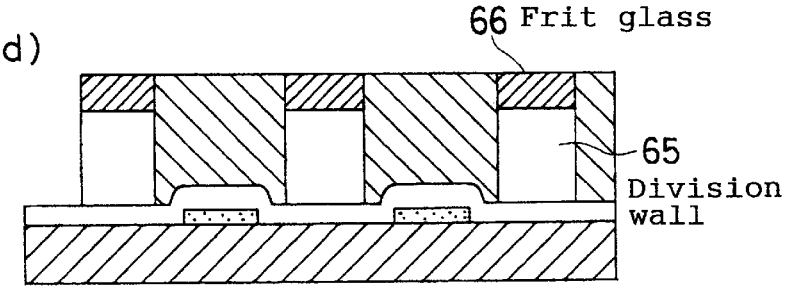
Figure 3E:
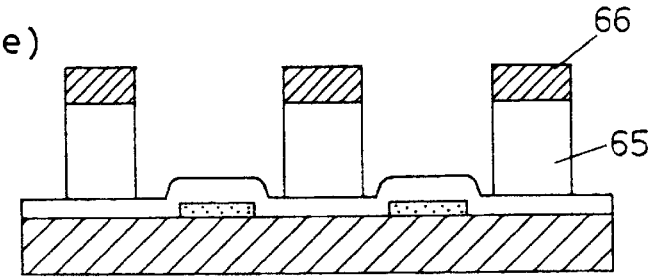
Figure 4A:
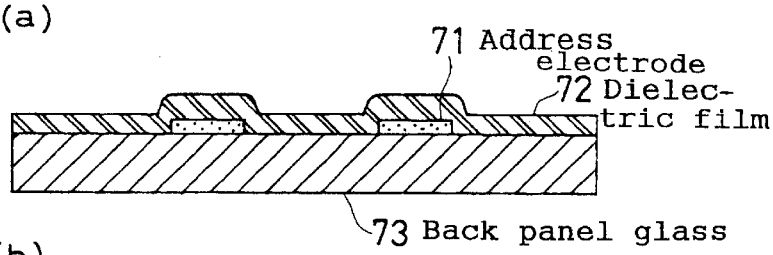
FIGS. 4(*a*) through (*e*) are schematic process diagrams of a method for manufacturing a plasma display panel according to fourth embodiment of the present invention.
Figure 4B:
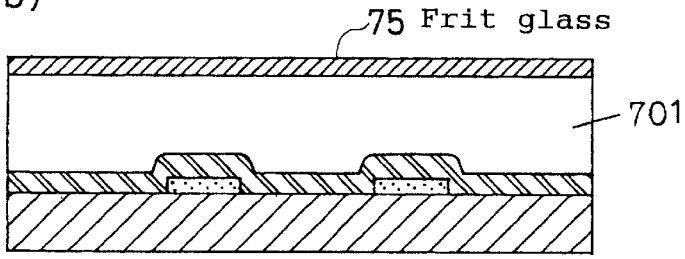
Figure 4C:
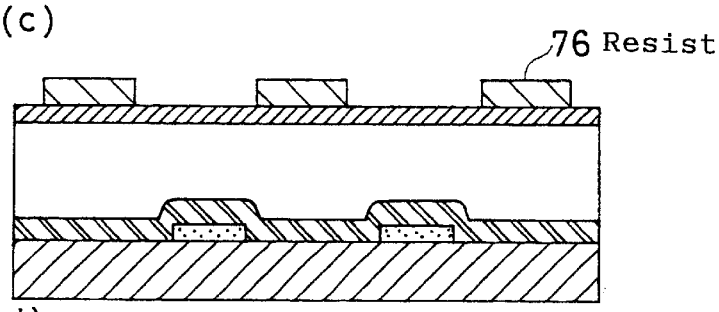
Figure 4D:
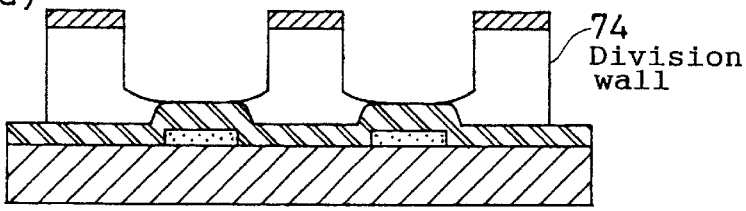
Figure 4E:
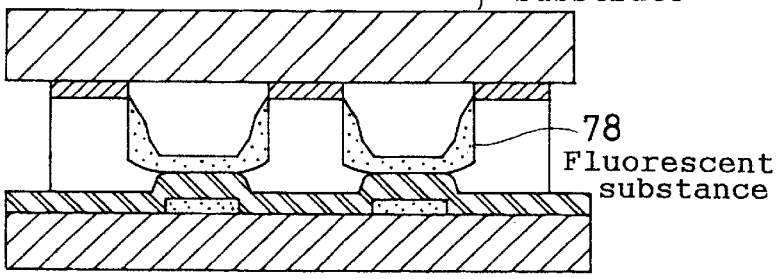

FIG. 2 is a schematic partial sectional view of a PDP according to second embodiment of the gas discharge panel of the present invention. Configuration of the PDP according to this embodiment will be described below with reference to this drawing.

Configuration of the PDP according to this embodiment is substantially the same as that shown in FIG. 1, except that bottom portions of the division walls 50 are bonded onto the back substrate 108 by frit glass 52, and therefore description thereof will be omitted.

The division walls 50 have the frit glass 31, 52 applied in advance to the bottom portions 50*b* and the ridges 50*a* thereof.

The frit glass 31 used for bonding the inner surface of the front substrate 21 with the ridges 50*a* of the division walls 50 may be either applied to the ridges 50*a* of the division walls 50 or applied to the inner surface of the front substrate 21 in a pattern before putting them together.

The frit glass 52 applied between the division walls 50 and the dielectric layer 53, on the other hand, is effective in case the division walls 50 and the dielectric layer 53 are made of different materials and are bonded together with a relatively weak bonding force. As the frit glass 52 infiltrates the holes formed in the division walls 50, it has an effect of reinforcing the division walls 50. The frit glass 52 may be either formed at the same time as the division walls 50 are formed, or formed in the specified pattern on the dielectric layer 53 in advance before forming the division walls 50 thereon.

Thus according to this embodiment, similar effects as those of the first embodiment can be achieved.

Embodiment 3

FIGS. 3(*a*) through (*e*) schematically show processes of an embodiment of a method for manufacturing the gas discharge panel according to the present invention. The method for manufacturing the PDP according to this embodiment will be described below with reference to these drawings.

As shown in FIG. 3(*a*), reference numeral 61 denotes address electrodes and 62 denotes a back panel glass. In this process, the address electrodes 61 are formed in a pattern on the surface of the back panel glass 62.

Then as shown in FIG. 3(*b*), a dielectric film 63 is formed to cover the address electrodes 61 and the surface of the back panel glass 62.

A resist 64 is then applied to the surface of the dielectric film 63 and is patterned through exposure to light as shown FIG. 3(*c*).

Then as shown in FIG. 3(*d*), portions missing the resist 64 are filled with division walls 65 made mainly of alumina by thermal spraying, followed by filling with frit glass 66. The frit glass 66 may be applied either by thermal spraying or other method, for example printing or simple squeezing.

The resist 64 is then removed to leave the frit glass 66 on the ridges of the division walls 65 as shown in FIG. 3(*e*)

The back substrate made through the series of processes described above is disposed to oppose the front substrate and fired, with these substrates being sealed to form a space which is then filled with a gas.

With the method described above, the PDP of a configuration similar to those described in conjunction with the first and the second embodiments is made very easily wherein the front substrate and the back substrate are joined together on the ridges of the division walls 65.

Use of this method eliminates the need for the process of firing the division walls, thereby reducing the energy consumption.

The firing processes can be combined into a single process by applying a fluorescent substance to the surface between the ribs of the division walls 65 after the division walls have been formed by thermal spraying and the frit glass has been applied, then firing the fluorescent substance and carrying out boding and sealing of the two substrates at the same time.

That is, in contrast to the prior art where the division wall firing process, the fluorescent substance firing process and the firing process carried out when sealing the entire panel are carried out separately, two firing processes are eliminated in this embodiment thereby achieving great effects of reducing the facilities and reducing the energy consumption.

Although a firing process is required when the material to make the division walls includes fusible glass, carrying out this firing operation and the firing operation for sealing the entire panel simultaneously makes it possible to eliminate two of the firing processes of the prior art, similarly to the case described above.

Also in case the bonding member used for bonding the ridge of the division walls and the inner surface of the front substrate includes fusible glass, an organic binder and an organic solvent, it is necessary to heat the bonding member in a preliminary firing process in order to remove the organic binder and the organic solvent included therein. The preliminary firing process is provided after the application of the bonding member and before sealing of the panel.

Embodiment 4

FIGS. 4(*a*) through (*e*) are diagrams schematically showing processes according to one embodiment of a method for manufacturing the gas discharge panel of the present invention. The method for manufacturing the PDP according to this embodiment will be described below with reference to these drawings.

As shown in FIG. 4(*a*), reference numeral 71 denotes address electrodes, 72 denotes a dielectric film and 73 denotes back panel glass. A layer of a mixture of alumina and frit glass (denoted by reference numeral 701 in the drawing) is formed over the dielectric film 72, for the formation of division walls 74.

Then a layer of frit glass 75 is formed over the surface as shown in FIG. 4(*b*). The division walls 74 and the frit glass 75 are formed by thermal spraying.

The frit glass 75 may also be formed by applying the glass by a printing process and then firing.

Then as shown in FIG. (*c*), a pattern is formed by exposure of a resist 76, a dry film or the like to light.

The material is then removed by sand blast from portions where the resist 76 is not deposited thereby to form the division walls 74, as shown in FIG. 4(*d*). The division walls 74 have the frit glass film described in conjunction with FIG. 4(*b*) deposited on the ridges thereof.

The front substrate and the back substrate are then sealed to assemble the panel by using the sealing member as shown in FIG. 4(*e*), with the panel being sealed by firing while bonding with the division walls 74 at the same time. While the sealing operation and bonding of the ridges of the division walls 74 with the inner surface of the front substrate are preferably carried out simultaneously in view of energy saving in the manufacturing process, they may also be carried out in separate processes as a matter of course.

Although the fluorescent substance 78 is applied after forming the division walls 74, the fluorescent substance 78 maybe fired either during sealing or separately before sealing.

Number of firing processes can be reduced also with this manufacturing method that provides great effects of reducing the manufacturing facilities and energy consumption.

Also according to this embodiment, since the mixture of alumina and frit glass is used as the material to make the division walls and the frit glass fills the voids of alumina during sealing, void ratio decreases and division walls with less outgassing can be achieved. As a consequence, it is made possible to decrease pollution due to impurity gas and elongate the service life of the panel.

Embodiment 5

Figure 5:
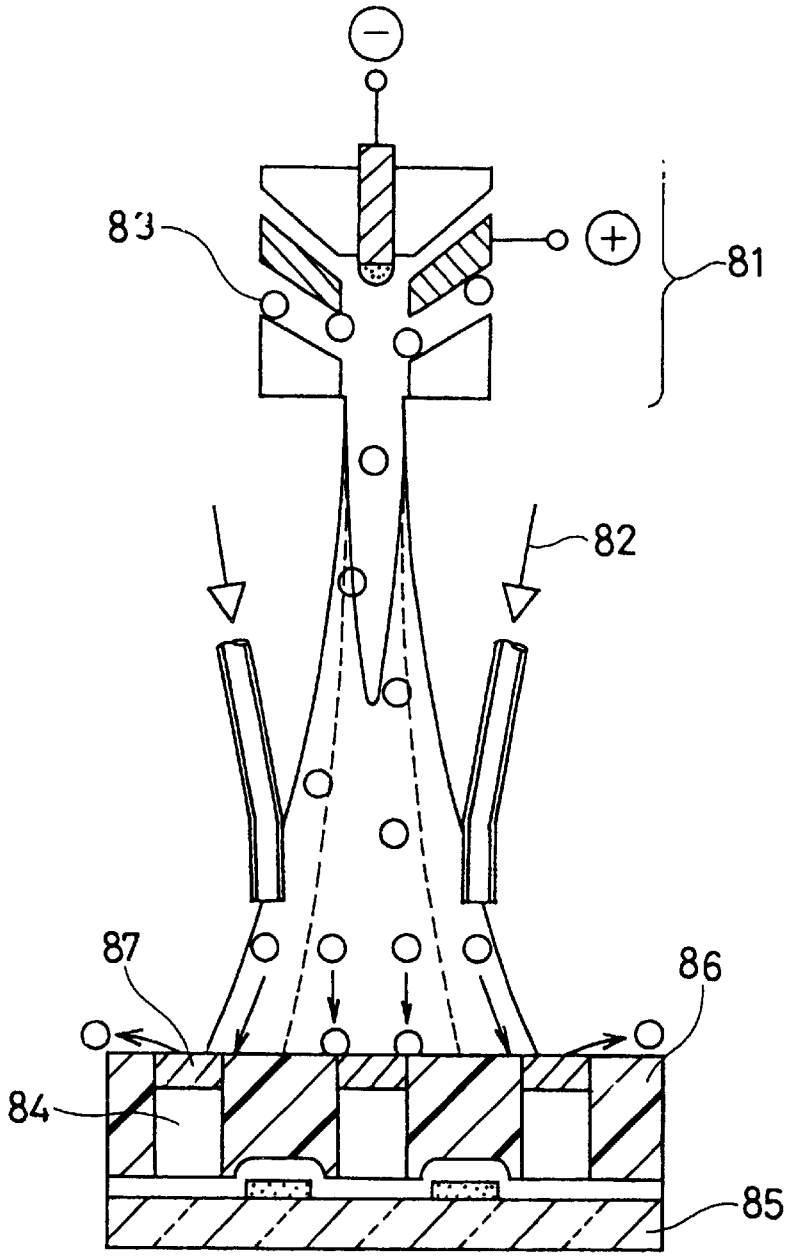
FIG. 5 is a schematic diagram showing a method for forming division walls by thermal spraying according to an embodiment of the present invention.

FIG. 5 schematically shows a method forming the division walls by thermal spraying, which is an embodiment of a method for manufacturing the gas discharge panel according to the present invention. The thermal spray method of this embodiment will be described below with reference to this drawing.

As shown in FIG. 5, reference numeral 81 denotes a thermal spray torch and 82 denotes a coolant gas. The coolant gas 82 removes unnecessary heat generated by the thermal spray and keeps the substrate temperature within 200° C. Reference numeral 83 denotes a powdery material to make the division walls 84 that is supplied with frit glass 87. Reference numeral 86 denotes a dry film for masking portions where the division walls are not to be formed. Reference numeral 85 denotes the back panel glass, 89 denotes the address electrodes and 88 denotes the dielectric film.

The material to make the division walls included in the molten powder 83 sprayed from the thermal spray torch 81 is deposited in gaps between the dry films 86 which have been exposed to light and developed, to form a film having thickness of about 60% of the gap depth, followed by spraying of the frit glass 87 to form a film. Because the thermal spray is applied while cooling with the coolant gas 82, the dry film 86 is cooled down to such a temperature that is not harmful. When the dry film is removed, the division walls 84 with the frit glass 87 layer formed thereon are obtained.

According to this embodiment, the division walls with the frit glass layer formed on the ridges thereof can be formed by a very simple method, and therefore number of the firing processes can be reduced while providing great effects of reducing the manufacturing facilities and energy consumption.

According to this embodiment, as described above, the front substrate and the back substrate are bonded together and therefore the panel does not swell at the middle unlike the prior art even when the inner pressure of the PDP increases.

Also in the presence of vibration, there occurs no such problem as the front substrate and the back substrate vibrate independently of each other due to difference in the resonance frequency arising from the difference in the mass thereof.

As a consequence, better image quality with less cross talk and less image disturbance can be achieved even in such places as in an airplane where the atmospheric pressure is unstable or low, and in an environment which is affected by much vibrations.

Also such a configuration as described above allows it to increase the filling gas pressure to the atmospheric pressure or higher, thus making it possible to achieve the PDP of high brightness and high efficiency.

In addition, the manufacturing method of the present invention makes it possible to greatly reduce the number of the firing processes and provide great effects of reducing the manufacturing facilities and energy consumption.

As will be apparent from the above description of the preferred embodiments, the PDP of the present invention has such a configuration as the division walls formed on the back substrate or on the front substrate are bonded to the other substrate by means of the frit glass. And the manufacturing method is such that the division walls are formed by thermal spraying with the frit glass also being applied to the ridges thereof by thermal spraying, while bonding of the division walls and the front substrate, sealing of the back substrate and the front substrate and firing of the fluorescent substance are carried out simultaneously.

As a consequence, because the front substrate and the back substrate are bonded with the frit glass on the ridges of the division walls, the panel does not break nor swell even when the pressure of the gas that fills the inside the panel is higher than the atmospheric pressure. Thus the problems including cross talk do not occur, while good image is obtained and higher safety is achieved even when used onboard an airplane or the like. Also even when the panel is subject to vibration or the like, the substrates do not deflect because the front substrate and the back substrate are bonded together, and therefore good image is obtained even when used onboard a train, automobile or the like. Furthermore, because the pressure of the discharge gas that fills the inside can be made higher than the atmospheric pressure according to this embodiment, PDP of high brightness and high efficiency can be achieved.

Also according to the present invention, because bonding of the division walls and the front substrate, sealing of the back substrate and the front substrate and firing of the fluorescent substance are carried out simultaneously unlike the prior art, it is made possible to reduce the number of the firing processes and reduce the electric energy required for manufacturing the PDP, thus achieving cost reduction.

Now preferred embodiment of the gas discharge panel and the method for manufacturing the same according to the present invention will be described below with reference to the accompanying drawings.

Embodiment 6

Figure 6:
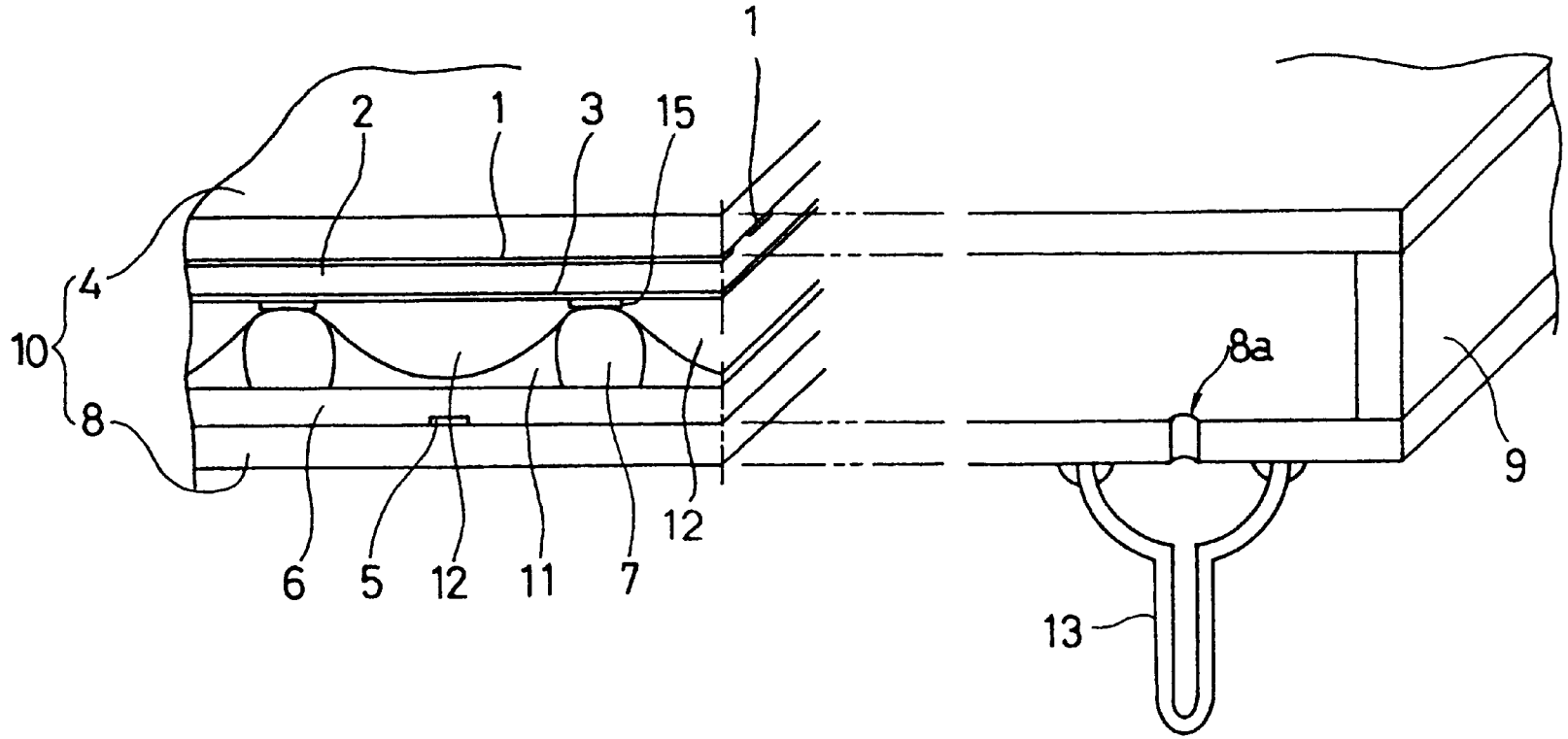
FIG. 6 is a perspective cutaway view schematically showing the configuration of a key portion of a PDP according to this embodiment.
Figure 7:
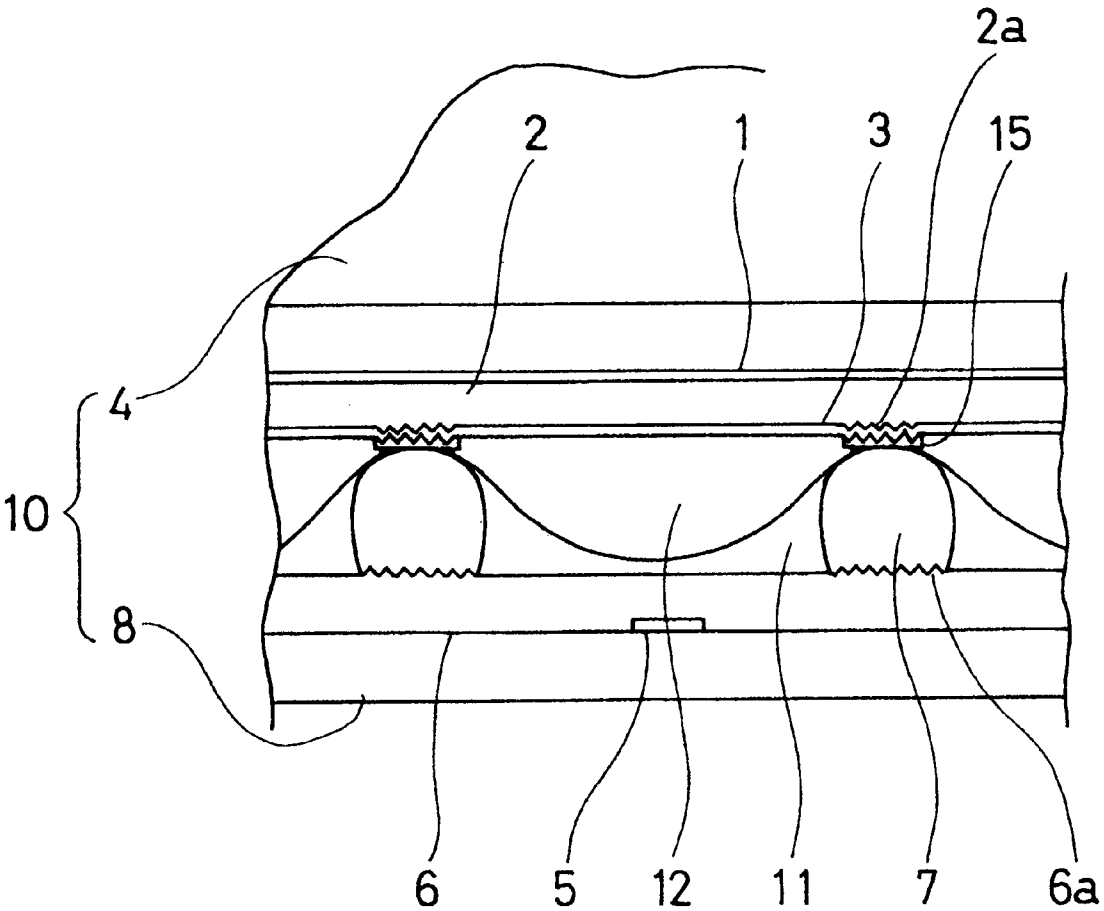
FIG. 7 is a sectional view according to a variation thereof.
Figure 8:
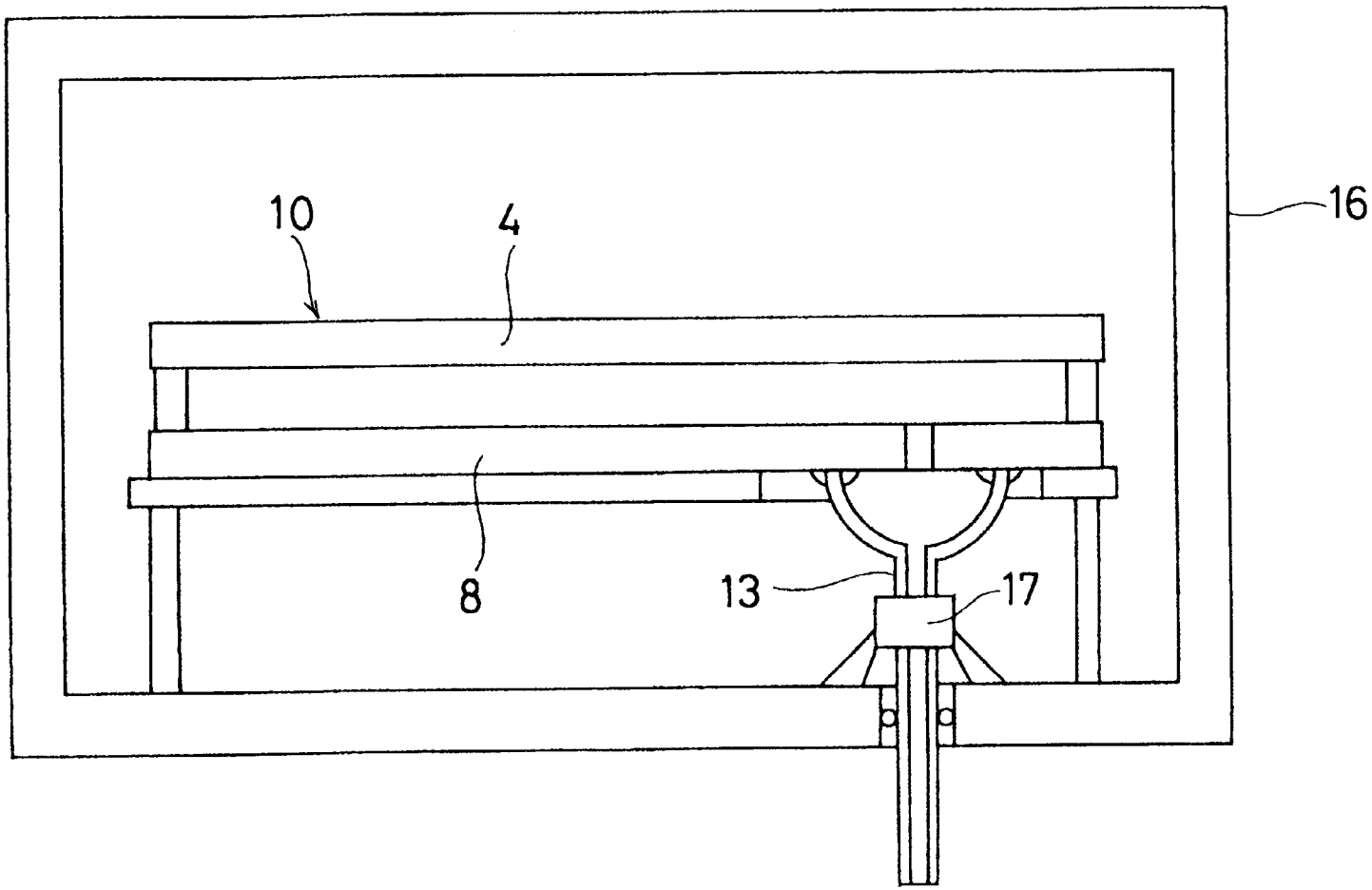
FIG. 8 is a drawing showing a method for closing a piping member of the PDP according to this embodiment.
Figure 9:
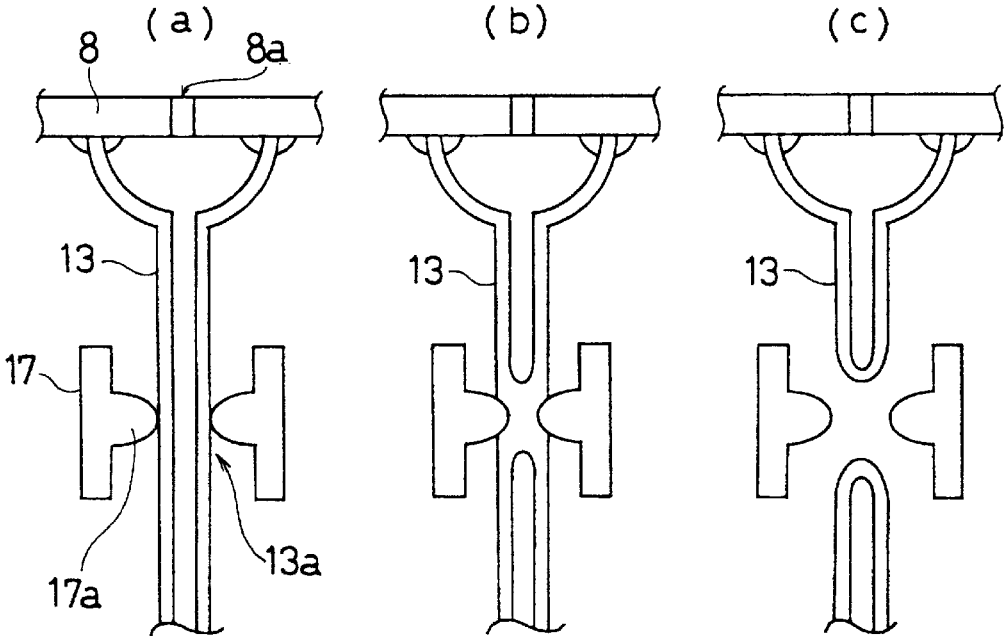
FIG. 9 is a drawing showing first variation of the method and procedure for closing the piping member of the PDP according to this embodiment.
Figure 10:
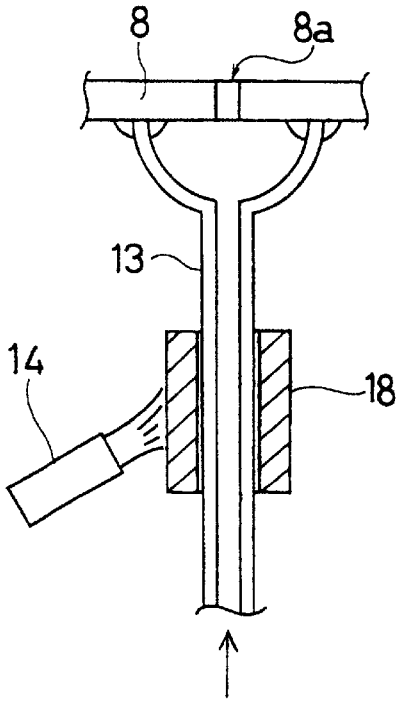
FIG. 10 is a drawing showing a second variation of the method and procedure for closing the piping member of the PDP according to this embodiment.
Figure 11:
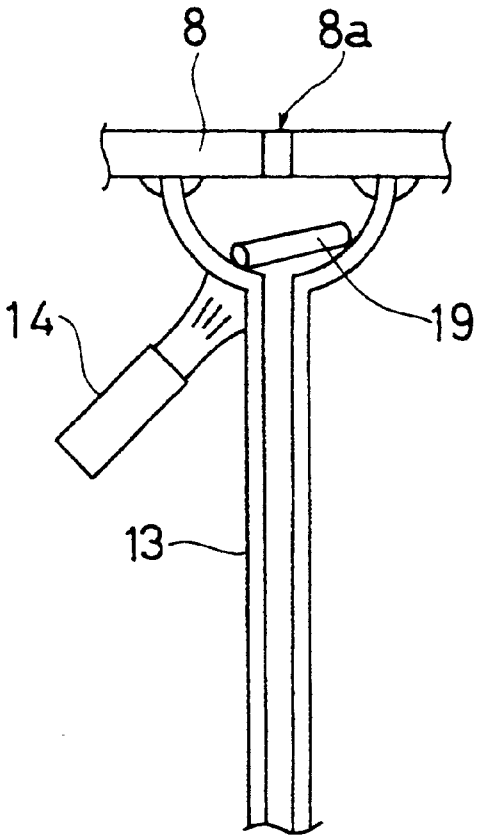
FIG. 11 is a drawing showing a third variation of the method and procedure for closing the piping member of the PDP according to this embodiment.
Figure 11:
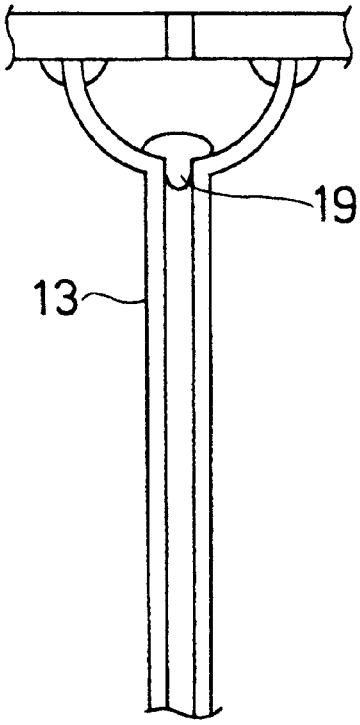

FIG. 6 is a perspective cutaway view schematically showing the configuration of a key portion of the PDP according to one embodiment of the gas discharge panel of the present invention. FIG. 7 is a sectional view according to a variation thereof. FIG. 8 is a drawing showing a method for closing the piping member in the manufacture of the PDP according to this embodiment. FIG. 9 through FIG. 11 are drawings showing first through third variations of the method and procedure for closing the piping member.

Figure 20:
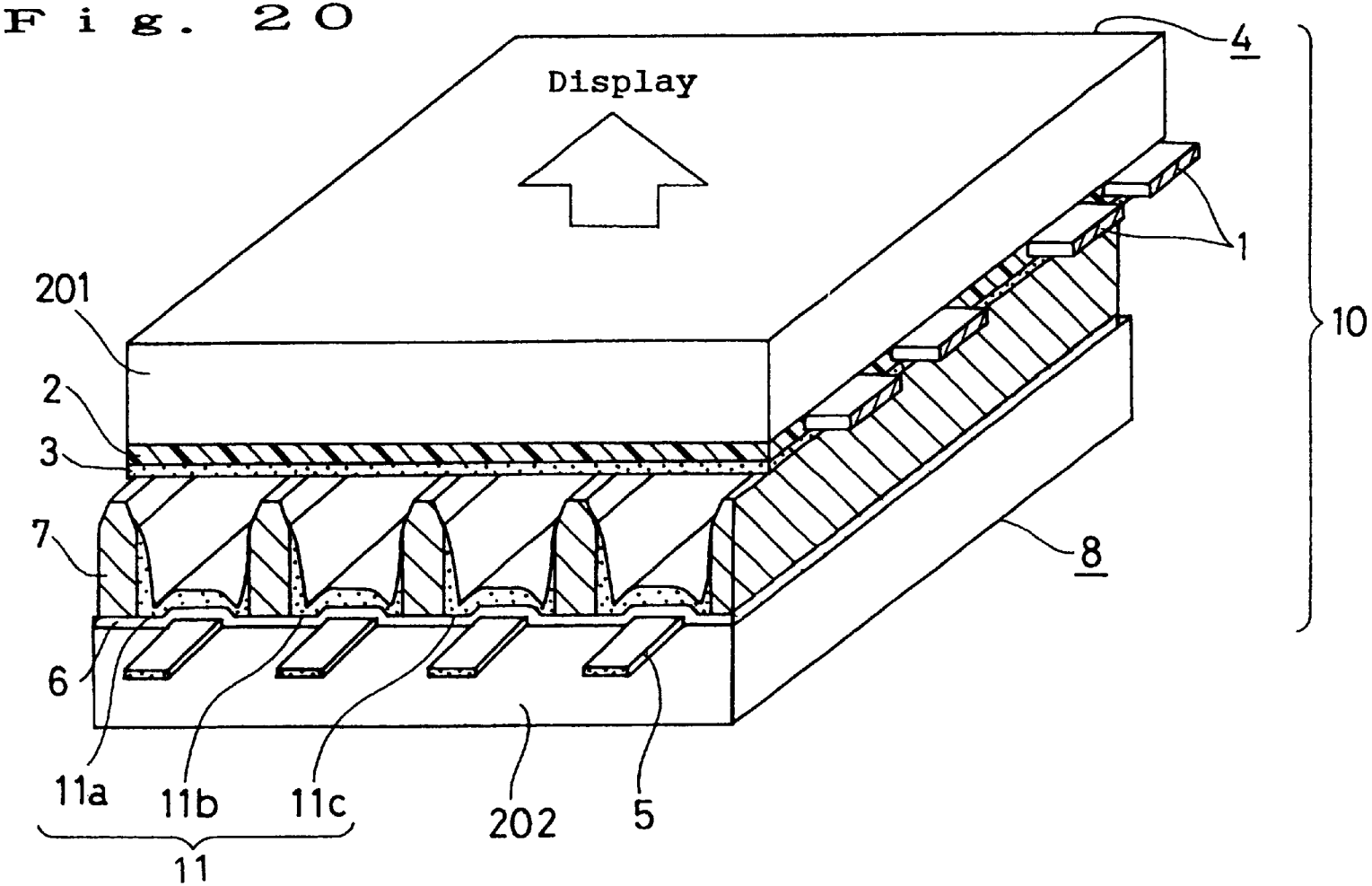
FIG. 20 is a perspective sectional view of a portion of the plasma display panel of the prior art.
Figure 21:
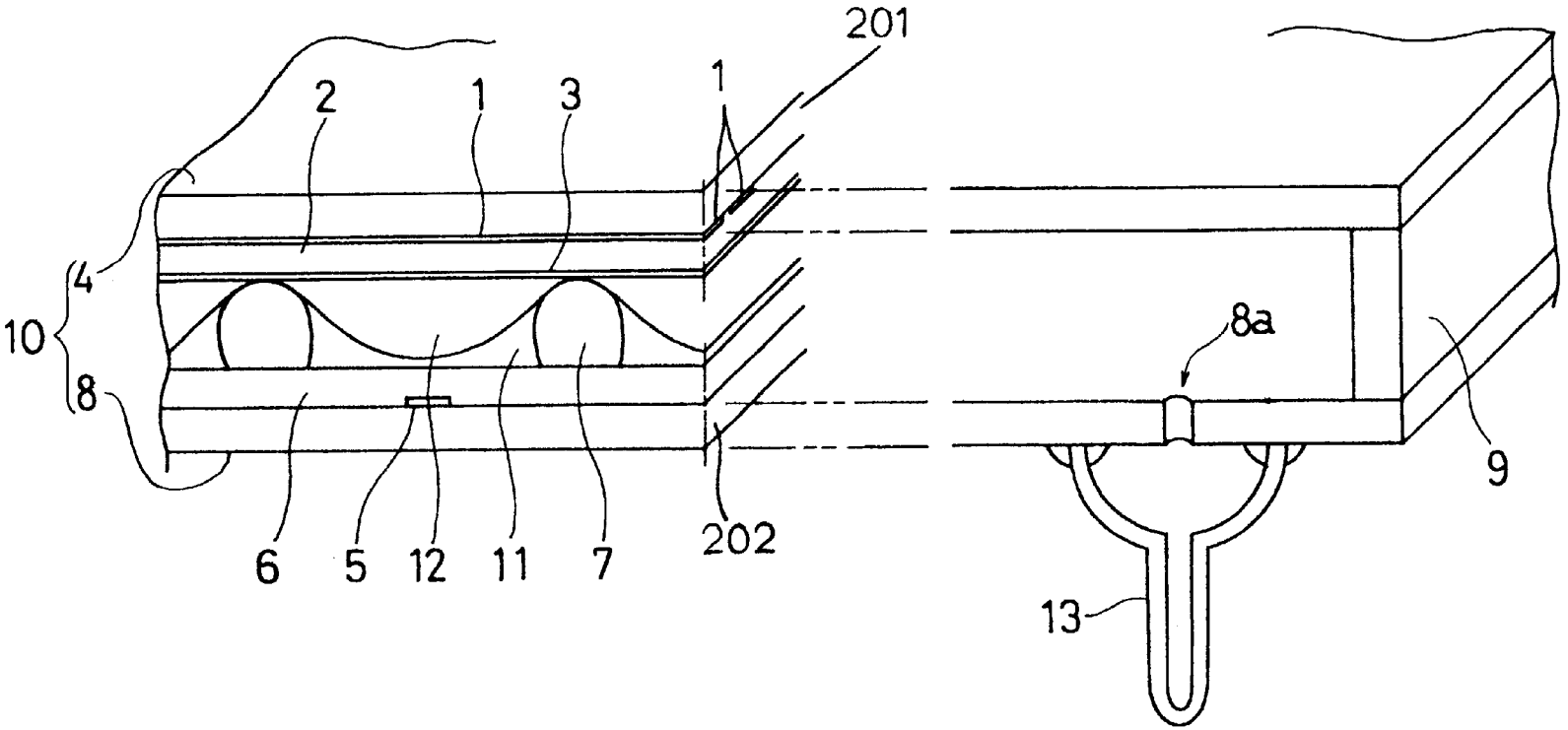
FIG. 21 is a perspective cutaway view schematically showing configuration of a key portion of the PDP of the prior art.
Figure 22:
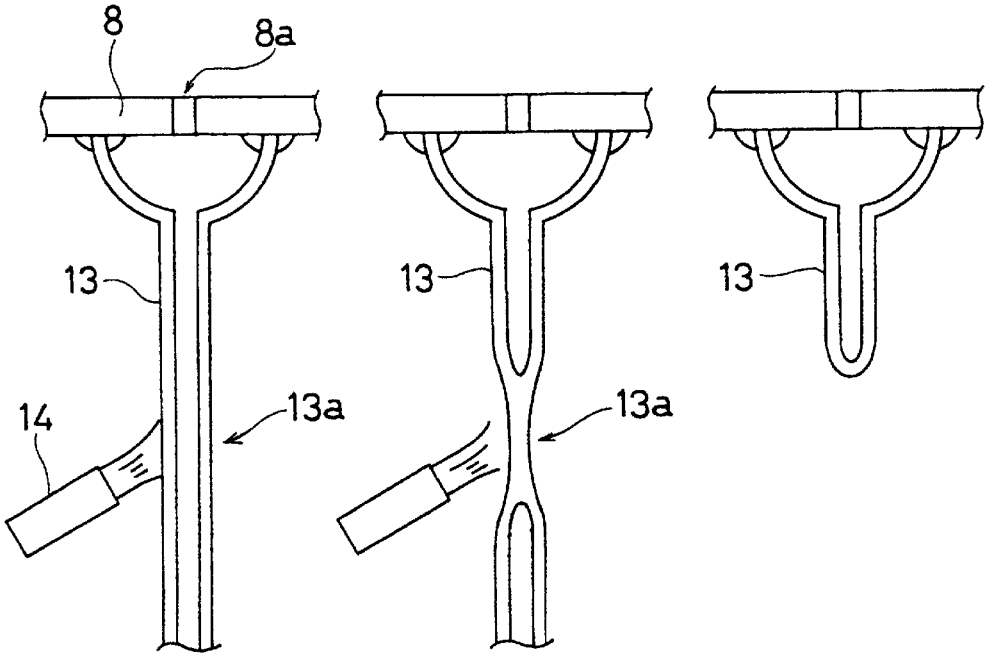
FIGS. 22(*a*) through (*c*) are diagrams showing a procedure of closing the piping member of the PDP according to the prior art.

As the overall configuration of the PDP according to this embodiment is basically the same as that of the PDP of the prior art described with reference to FIG. 20 and FIG. 21 in many aspects, parts or portions identical or equivalent to those described with reference to FIG. 20 and FIG. 21 will be denoted with the same reference numerals.

As shown in FIG. 6, the casing 10 according to this embodiment has such a configuration as the upper panel substrate 4 and the lower panel substrate 8 are disposed to oppose each other while peripheries of the two panel substrates 4, 8 are sealed with a sealing member 9 made of glass having a low melting-point, thereby forming a discharging space therein.

The upper panel substrate 4 is a substrate made of glass having a plurality of display electrodes 1, the dielectric layer 2 made of glass having a low melting point covering the display electrodes 1 and a protective film 3 made of magnesium oxide in a thin film being formed on the inner surface thereof. The lower panel substrate 8 is a substrate made of glass having a plurality of data electrodes 5 disposed at right angles to the display electrodes 1 and a dielectric layer 6 made of glass having a low melting point being formed on the inner surface thereof, while division walls 7 made of glass having a low melting point are formed in parallel to each other at predetermined positions on the dielectric layer 6 in order to separate compartments of light emitting regions.

The division walls 7 have, on the ridges thereof, bonding members 15 made of a material having a low melting point such as frit glass (melting point of about 450° C.) or water glass having a melting point lower than that of the material making the division wall 7 which is from 500 to 600° C. The division walls 7 formed on the lower panel substrate 8 and the upper panel substrate 4 are bonded by the bonding member 15.

The bonding member 15 may also be made of an ultraviolet adhesive having low hygroscopicity and less outgassing or a common sealing material used in vacuum applications. Although the bonding member 15 is made of a material having a melting point lower than that of the division walls 7 in this embodiment in consideration of the convenience in the manufacturing process, a common adhesive may also be used regardless of the melting point as long as the manufacturing process allows it. Also the bonding members 15 may not necessarily be provided along the entire length of the ribs of the division walls 7. That is, the bonding members 15 may be provided at separate predetermined positions, as a matter of course.

Meanwhile, as shown in FIG. 7, the bonded portions 2*a* on the dielectric layer 2 of the upper panel substrate 4, namely the portions to be bonded with the ridges of the division walls 7 by means of the bonding members 15, and/or portions 6*a* of the dielectric layer 6 of the lower panel substrate 8 where the division walls 7 are to be formed, namely either one or both of the predetermined portions 2*a*, 6*a* of the dielectric layer 2 and the dielectric layer 6 may have rough surface with fine irregularities formed thereon. With this configuration, the rough surface provides an anchoring effect.

Specifically, bonding strength between the dielectric layer 2 of the upper panel substrate 4 and the ridges of the division walls 7 via the thin protective film 3 and the bonding member 15 and the bonding strength between the dielectric layer 6 of the lower panel substrate 8 and the bottom of the division walls 7 are increased.

The rough surface may be provided by such a common method as masking the portions which are not to be roughened and applying sandblast. In this case, because the dielectric layer 6 of the lower panel substrate 8 is covered by the fluorescent substance 11, the dielectric layer 6 may also be roughened over the entire surface thereof.

In addition, the dielectric layer 6 in each light emitting region separated by the division walls 7 is coated with the fluorescent substance 11 in order to produce color display. The inner space of the casing 10 formed by bonding the upper panel substrate 4 and the division walls 7 of the lower panel substrate 8 via the bonding members 15 is filled with a discharge gas comprising a mixture of helium, xenon, neon or the like, with an inner pressure exceeding 500 Torr, for example from 750 Torr to 1000 Torr.

As shown in FIG. 6, the lower panel substrate 8 bears the piping member 13, that was used when purging air from the inner space of the casing 10 and filling it with the discharge gas, remaining thereon as bonded by using the same material as the sealing member 9.

With this configuration, even when the inner pressure of the casing 10 is higher than the pressure acting on the outer surface of the casing 10, namely atmospheric pressure, the upper panel substrate 4 and the lower panel substrate 8 are bonded together by the bonding members 15 provided on the ridges of the division walls 7. As a result, the adjoining compartments 12 that serve as the light emitting regions do not communicate with each other through gaps, that is, the adjoining compartments 12 are surely isolated from each other, and such a problem does not occur as the panel substrates 4, 8 swell toward the outside and deform.

Although such a configuration has been described as the inside of the casing 10 of the PDP is filled with the discharge gas with a pressure higher than 500 Torr, it does not need to say that the discharge gas pressure may not necessarily be higher than 500 Torr, and may be 500 Torr or lower.

PDPs may be used onboard airplanes or trains, and subject to changes in the atmospheric pressure during sharp ascent or sharp dive of an airplane or vibration of a running train. Even in such cases, provided that the upper panel substrate 4 and the lower panel substrate 8 that constitute the casing 10 are bonded together by the bonding members 15 provided on the ridges of the division walls 7, such a problem never occurs as the casing 10 swells toward the outside and deform when the atmospheric pressure changes or under the presence of vibration.

Now the method for manufacturing the PDP of the configuration described above according to the preferred embodiment of the gas discharge panel of the present invention will be described below with reference to the accompanying drawings.

First, the upper panel substrate 4 whereon the display electrodes l, the dielectric layer 2 and the protective layer 3 are formed, and the lower panel substrate 8 whereon the data electrodes 5, the dielectric layer 6 and the division walls 7 are formed and the fluorescent substance 11 applied thereon are manufactured.

With these panel substrates being prepared, the bonding members 15 made of a material having a low melting point such as frit glass is applied onto the ridges of the division walls 7 of the lower panel substrate 8.

While the bonding members 15 are applied by such a technique as screen printing or transferring by means of a stamper, the bonding members 15 may also be provided by lift-off or the like before applying the fluorescent substance 11 thereon. Also in case the division walls 7 are formed through a plurality of screen printing operations, the bonding members 15 can be provided by forming only the uppermost layer from frit glass or the like, or alternatively, the frit glass or the like that makes the bonding members 15 may be applied to predetermined portions of the upper panel substrate 4 which correspond to the division walls 7 provided on the lower panel substrate 8. In screen printing, it is common to form a pattern through which an adhesive material of predetermined viscosity passes for a screen plate that makes contact with the ridges of the division walls 7, the bonding members 15 may also be provided only on the ridges of the division walls 7 by screen printing, after making the screen plate through the entire surface of which the adhesive material can pass.

Then the upper panel substrate 4 and the lower panel substrate 8 are disposed to oppose each other via the division walls 7 whereon the bonding members 15 are provided as described above, and the two panel substrates 4, 8 are heated with the sealing member 9 provided between the peripheries thereof. This causes the upper panel substrate 4 and the lower panel substrate 8 to be sealed on the peripheries thereof by the sealing member 9, resulting in the formation of the casing 10. At this time, the upper panel substrate 4 and the lower panel substrate 8 are bonded together by the bonding members 15 that has melted in the heating process.

The piping member 13 that communicates with the inside of the casing 10 via the through hole 8a formed in the lower panel substrate 8 that constitutes the casing 10 is attached at a place outside the lower panel substrate 8.

And through the piping member 13, the inside the casing 10 is evacuated of the air and is filled with the discharge gas.

Then the piping member 13 is closed thereby to seal the inner space of the casing 10, thus completing the PDP shown in FIG. 6.

In case the casing 10 is filled with the discharge gas with a pressure exceeding 500 Torr, the piping member 13 is closed by a method, for example, shown in FIG. 8.

First, as shown in FIG. 8, the piping member 13 that communicates with the inside of the casing 10 via the through hole 8a formed on the lower panel substrate 8 that constitutes the casing 10 is attached at a place outside the lower panel substrate 8. The casing 10 with the piping member 13 attached thereto is placed at a proper position in a pressured chamber 16, while heating means 17 such as an induction heater or an electric heater is disposed along the periphery of the closing portion 13*a* of the piping member 13.

Through the piping member 13, air inside the casing 10 is purged and the inside of the casing 10 is filled with the discharge gas with a predetermined pressure exceeding 500 Torr.

Then the inner pressure of the pressured chamber 16 is set to a level higher than the pressure of the discharge gas in the casing 10.

As this makes the inner pressure of the pressured chamber 16 higher than the inner pressure of the casing 10, the piping member 13 can be closed in a procedure similar to that of the prior art.

That is, the closing portion 13*a* of the piping member 13 is heated and melted by the heating means 17. As the lower portion of the closing portion 13*a* is pulled away from the casing 10, the closing portion 13*a* of the piping member 13 which has been cut off by melting is closed, thereby sealing the casing 10. While the piping member 13 is closed by setting the pressure acting on the outer surface of the casing 10 higher than the inner pressure of the discharge gas in this embodiment, it is not necessary to employ such a laborious method. It is a matter of course that the piping member 13 can be closed similarly to the prior art simply by setting the pressure acting on the piping member 13 higher than the discharge gas pressure that fills the casing 10.

Now variations of the method and procedure of closing the piping member 13 will be described below with reference to FIG. 9 through FIG. 11.

FIG. 9(*a*) through FIG. 9(*c*) show the first variation of the method and procedure of closing the piping member 13.

This method uses a sealing jig 17 that has a projection 17a having a section of semicircular or triangular configuration formed thereon to press the piping member 13 along the radial direction from at least two directions opposing along the radial direction of the piping member 13, and has a function of heating the piping member 13 via the projection 17*s*. With this method, the piping member 13 that communicates with the inside of the casing 10 via the through hole 8*a* formed in the lower panel substrate 8 that is one of the panel substrates is attached and, after purging the air from the inside of the casing 10 and filling it with the discharge gas through the piping member 13, the projection 17*a* of the sealing jig 17 is pressed against the closing portion 13*a* of the piping member 13 as shown in FIG. 9(*a*). Then the piping member 13 is heated while pressing the projection 17*a* of the sealing jig 17 thereto along the radial direction thereof as shown in FIG. 9(*b*), thereby cutting off the piping member 13 by melting it with the heat as shown in FIG. 9(*c*). When this method is employed, the closing portion 13*a* is closed as a result of pressing the projection 17*a* against the piping member 13 which has been heated to melt, and therefore the piping member 13 can be easily closed thereby to seal the casing 10, despite the inner pressure of the casing 10 being higher than the atmospheric pressure.

The piping member 13 may also be closed as in the second variation shown in FIG. 10, where a heating jig 18 fitted on the piping member 13 from the outside thereof is heated by means of a gas burner 14 or the like to melt the closing portion 13*a* of the piping member 13, while forcing the lower portion of the closing portion 13*a* in the direction of arrow, thereby to twist off the closing portion 13*a* while forcing it toward the casing 10. The heating jig 18 may be anything that can prevent the piping member 13 from swelling toward the outside due to the inner pressure that is higher than the atmospheric pressure and, while being omitted in the drawing, may be made of a metallic wire mesh. In case the heating jig 18 is stuck with the piping member 13, the heating jig 18 is left stuck with the piping member 13 which causes no problem at all.

Furthermore, the method of closing the piping member 13 described above may be replaced by the method shown in FIG. 11(*a*) and FIG. 11(*b*).

With this method of the third variation, the piping member 13 that communicates with the inside of the casing 10 via the through hole 8*a* formed in the lower panel substrate 8 that is one of the panel substrates is attached and, after purging the air from the inside of the casing 10 and filling it with the discharge gas through the piping member 13, the gas burner 14 or the like is used from the outside to heat and melt the sealing member 19 that has been formed in a short rod from a material having a melting point lower than that of the piping member 13 and housed in the piping member 13, thereby closing the piping member 13 as shown in FIG. 11(*b*). Then unnecessary portion of the piping member 13 closed with the sealing member 19 is removed by cutting off or other method. The sealing member 19 may be either housed in the piping member 13 in advance, put into the piping member 13 that has been attached to the lower panel substrate 8, or made of a material mixed with a black pigment to have high heat absorbing characteristic and is melted by irradiation of laser light.

In case the casing 10 is filled with the discharge gas with a pressure not higher than 500 Torr, it is common to employ the manufacturing method comprising processes similar to those of the prior art. But the method of this embodiment may also be employed even in such a case where the inner pressure of the casing 10 is lower than the external pressure.

As will be clear from the foregoing description, the gas discharge panel according to the present invention is characterized by, for example, the panel substrates that constitute the casing that are bonded together via the bonding members provided on the ridges of the division walls, while the casing 10 may be filled with the discharge gas of a pressure exceeding 500 Torr. The bonding member is preferably made of a material having a melting point lower than that of the division wall. In case the casing of such a configuration that the panel substrates are bonded together is used, the casing never deforms by swelling toward outside. In case the casing 10 is filled with the discharge gas with a pressure exceeding 500 Torr, there is such an advantage that brightness of the gas discharge panel is improved. The improvement in the brightness of the gas discharge panel is due to the improved gas discharge efficiency.

The method for manufacturing the gas discharge panel according to the present invention is for such a case, for example, as the inner pressure of the casing is higher than the external pressure during manufacturing, and is characterized in that the piping member is closed while keeping the pressure acting on at least the piping member from the outside higher than the discharge gas pressure that fills the casing, or the piping member is closed by heating while pressing the piping member from at least two directions opposing along the radial direction of the piping member, or the piping member is closed by melting the sealing member housed in the piping member. According to these manufacturing methods, the piping member can be easily and surely closed even when the inner pressure of the casing is higher than the external pressure.

As described above, according to the gas discharge panel of the present invention, due to such a configuration as, for example, the panel substrates that constitute the casing are bonded together via the bonding members provided on the ridges of the division walls, such problems never occur as a gap is produced between the division walls and the panel substrate or the casing deforms by swelling toward the outside. Thus there occurs no problem even when the casing is filled with the discharge gas with a pressure exceeding 500 Torr, thus making it possible to improve the brightness of the gas discharge panel.

Also according to the method for manufacturing the gas discharge panel of the present invention, even when the inner pressure of the discharge gas filling the casing is near equal to or higher than the atmospheric pressure, the piping member can be easily and surely closed and therefore the gas discharge panel of improved brightness can be easily manufactured.

According to the embodiments described above, the bonding members 15 can be formed on the ridges of the division walls 7 by, for example, screen printing or the like. However, the ridges of the division walls 7 are very narrow and long and it may be difficult to form the bonding members 15 uniformly thereon.

Also while the division walls 7 can be formed by printing, lift-off, sand blast or other process, the ridges may have uneven surfaces. The bonding member may not be formed on recessed portions on the ridges of the division walls 7, in which case the upper panel substrate 4 and the division wall 7 are not bonded together at the recessed portions, which may lead to deteriorated display quality at such portions.

Also when an excessive amount of the bonding member 15 is formed or the bonding member 15 is formed beyond the width of the division wall 7, the bonding member 15 after bonding has a width larger than the width of the division wall 7, where the light emitting region as viewed from the outside of the upper panel substrate 4 becomes narrower thereby leading to a decrease in brightness.

Meanwhile the sealing member 9 of the prior art is formed only on the periphery of the panel substrate, and pressure is applied only to the periphery of the panel substrate when sealing. However, while the division walls 7 and the upper panel substrate 4 must be bonded surely by the bonding members 15 in order to make the casing that does not deform, reliable bonding may not be achieved in the display region inside the panel substrate by applying pressure only to the periphery of the panel substrate even with such a configuration.

In consideration of these problems, a gas discharge panel and a method for manufacturing the same that are capable of preventing the PDP from deforming more reliably and achieve improvement in brightness will be described below.

Figure 12:
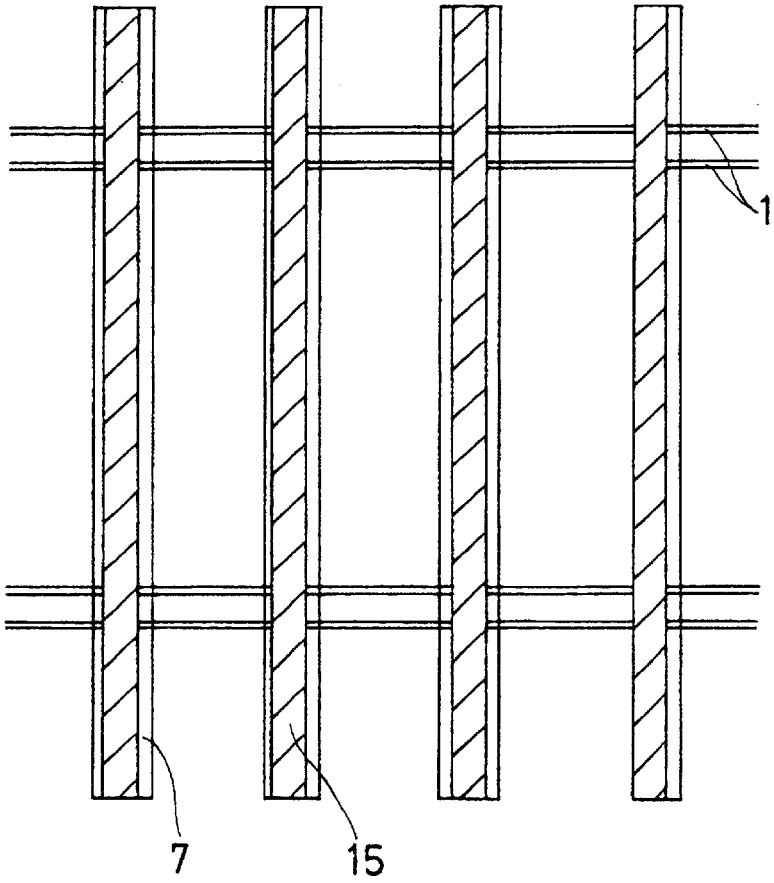
FIG. 12 is a plan view showing a bonding member for the PDP according to this embodiment.
Figure 13:
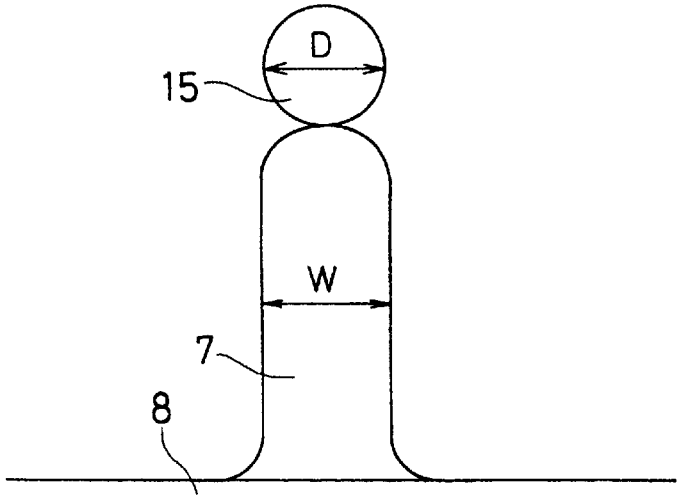
FIG. 13 is a schematic sectional view for the explanation of particle size of the bonding member.
Figure 14:
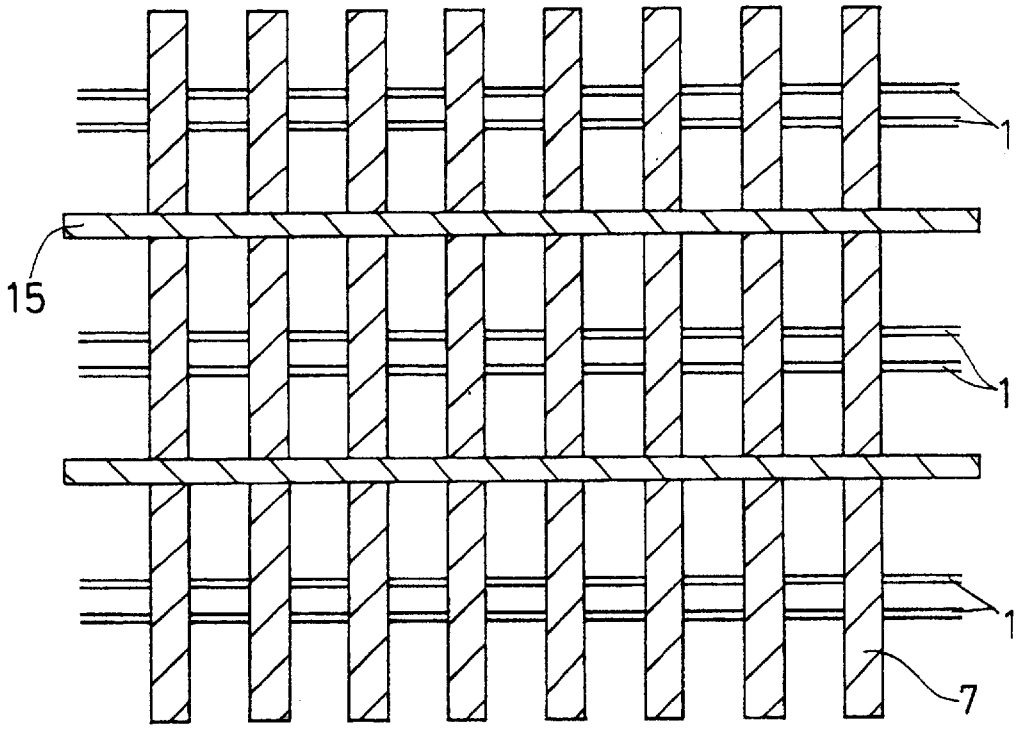
FIG. 14 is a plan view of a variation related to a method of applying the bonding member.
Figure 17:
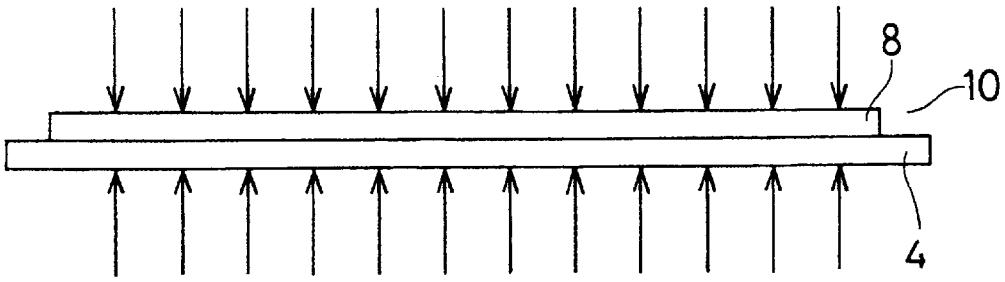
FIG. 17 is a schematic view showing a method of sealing the PDP according to this embodiment.
Figure 18:
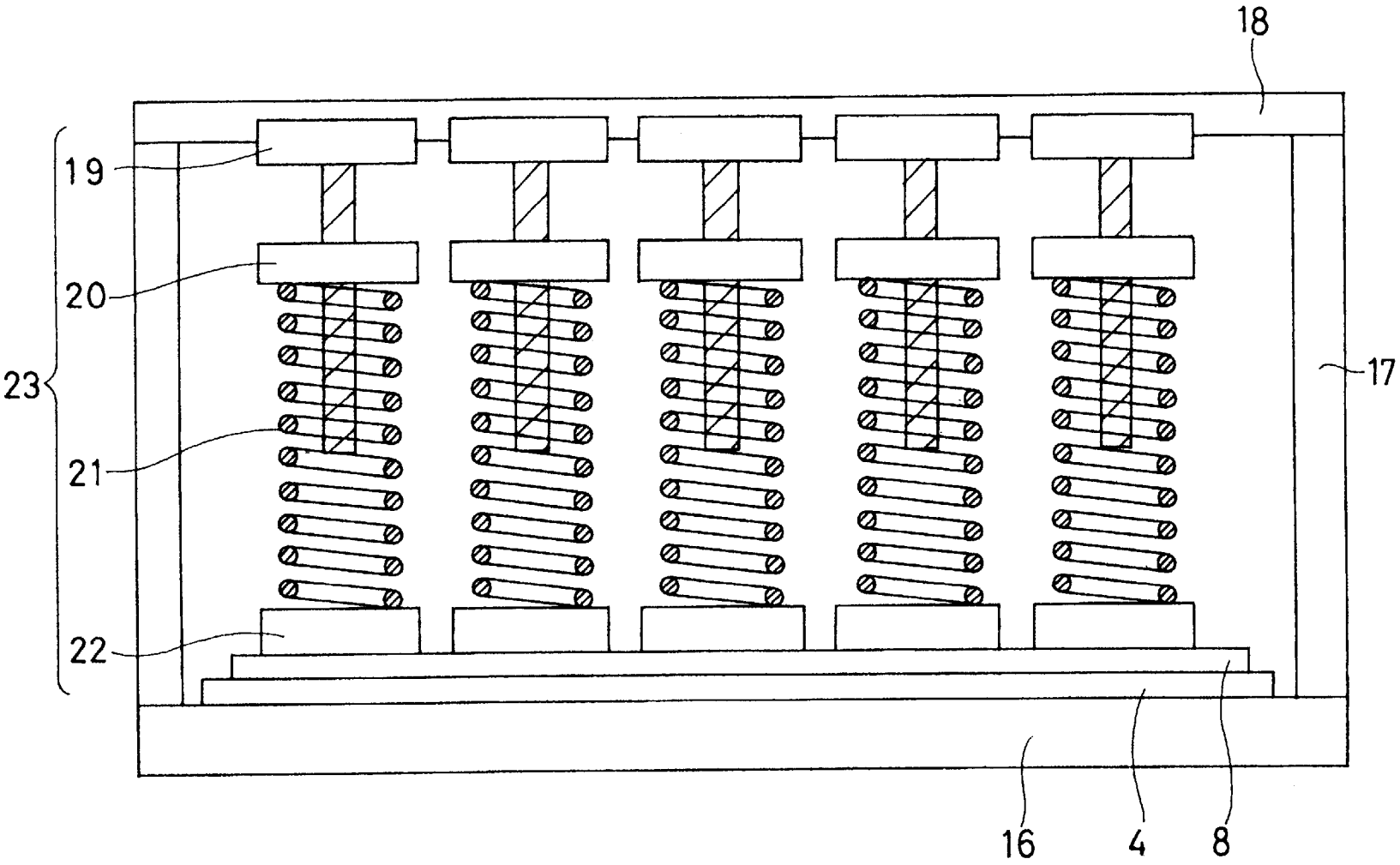
FIG. 18 is a sectional view showing a method of pressurizing during sealing.
Figure 19:
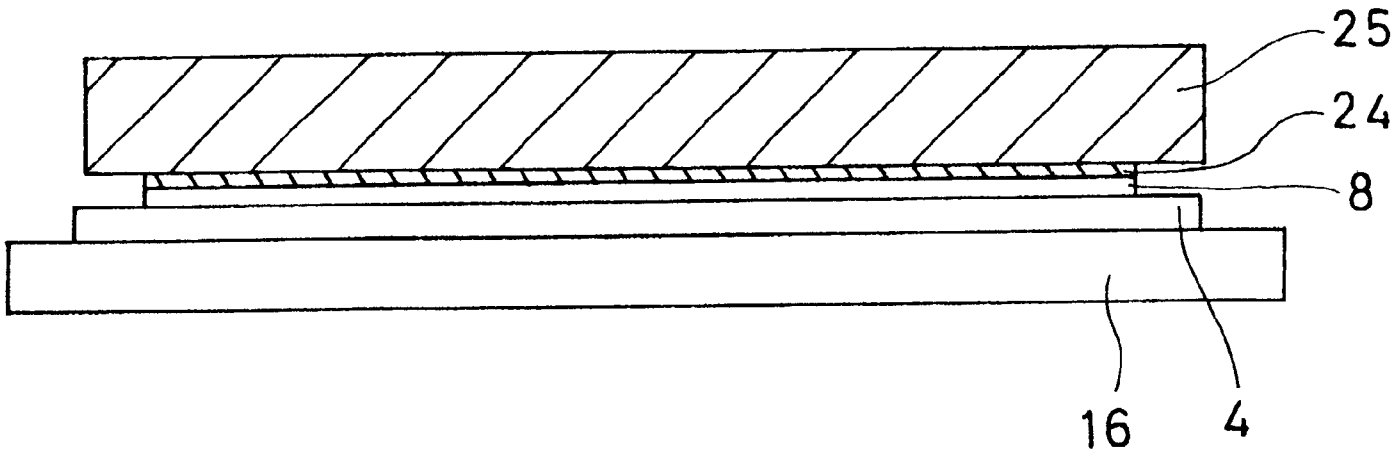
FIG. 19 is a sectional view showing a variation of the method of pressurizing during sealing.

FIG. 12 is a plan view showing the application of the bonding members 15, and FIG. 14 is a plan view of a variation thereof. FIG. 13 is a schematic sectional view for the explanation of the relationship between particle size of the bonding member and the division wall width of the PDP according to this embodiment. FIG. 17 is a sectional view showing a method of applying pressure during sealing. FIG. 18 and FIG. 19 are sectional views showing the method of pressurizing during sealing.

Overall configuration of the PDP according to this embodiment is basically the same as that shown in FIG. 6, and therefore parts or portions identical or equivalent to those described with reference to FIG. 6 will be denoted with the same reference numerals, and description thereof will be omitted.

The PDP according to this embodiment is as described with reference to FIG. 6.

That is, the ridges of the division walls 7 bear the bonding members 15 made of a transparent material formed thereon linearly along the longitudinal direction of the division walls 7 as shown in FIG. 12. The division walls 7 formed on the lower panel substrate 8 and the upper panel substrate 4 are bonded to each other via the bonding members 15.

The bonding members 15 formed on the ridges of the division walls 7 may partially project beyond the division wall width due to unevenness in the amount of application or the like, as described previously. Also when an excessive amount is applied when bonding with the upper panel substrate 4, the bonding member may be spread on top of the division wall and intrude into the light emitting region beyond the width of the division wall.

However, since the bonding member 15 is made of a transparent material, a little amount of it intruding into the light emitting region does not block the emitted light and does not cause deterioration in the display quality, particularly brightness.

In addition, the dielectric layer 6 in each light emitting region separated by the division walls 7 is coated with the fluorescent substance 11 to produce color display. And the casing 10 comprising the upper panel substrate 4 and the division walls 7 provided on the lower panel substrate 8 bonded together via y the bonding members 15 is filled with the discharge gas comprising a mixture of helium, xenon and neon at a pressure exceeding 500 Torr, for example from 760 Torr to 1000 Torr.

Now a variation of the bonding members 15 will be described below with reference to FIG. 13.

The frit glass which has been commonly used for the bonding member includes a material such as lead oxide and a filler such as ceramics added to control the thermal characteristics and to obtain desired bonding strength with the glass substrate.

FIG. 13 shows a case where maximum particle size D of the material such as the filler included in the bonding members 15 does not exceed the width W of the division walls 7. In this case the bonding member 15 does not project beyond the width of the division wall when the largest particle is located at the center of the division wall 7. Even when the largest particle is formed at a position somewhat offset from the center of the division wall 7, it does not significantly come out of the width of the division wall. Thus the PDP having good display characteristic can be obtained without covering the display region with the bonding members 15 after bonding the division walls 7 and the upper panel 4. What is important here is to keep the bonding members from significantly coming out of the width of the division wall after bonding, and this can be achieved with the configuration described above. To keep the bonding members from significantly coming out of the width of the division wall means to keep the bonding member from having such a width that substantially decreases the fluorescent substance region of each compartment 12 (FIG. 6). The fluorescent substance region is determined by the area of the compartment 12 where the fluorescent substance 11 is applied.

In case there is a gap larger than 5 $\mu$m between the division walls and the upper panel substrate, wile not shown in the drawing, cross talk or other deterioration in display occurs when turning on the panel.

When the particles included in the bonding member are large in size, on the other hand, the bonding member tends to be formed unevenly, there is a possibility that the division walls and the upper panel are bonded to each other only at a portion where the largest particle lies. For this reason, it is desirable that the maximum particle size included in the bonding member be 5 $\mu$m or less. In this embodiment, width W of the rib of the division wall (FIG. 13) is about 40 $\mu$m.

A PDP according to another variation of the bonding members 15 will be described below with reference to FIG. 14.

While the bonding members 15 described above are provided on the ridges of the division walls 7, the bonding members 15 are provided in linear configuration on the inner surface of the panel substrate 4. That is, as shown in FIG. 14, the bonding members 15 are formed linearly at the center between one set of display electrodes and an adjoining set of display electrodes which are disposed in a pair, in such a direction that crosses the division walls 7 formed on the lower panel substrate 8 substantially at right angles (for example substantially at right angles to the longitudinal direction of the division walls 7).

In this case, the bonding members 15 may be formed either by screen printing or drawing with a dispenser or the like. The two panel substrates 4, 8 that oppose each other are bonded together at points where the bonding members 15 and the division walls cross. Since the bonding members 15 are formed on a plane, they can be formed easily, and alignment can also be easily done when sealing because both the division walls 7 and the sealing member 15 have linear configuration and cross each other. Bonding is also made more reliably.

The bonding members 15 also have a function of visually separating pixels which adjoin each other in the longitudinal direction of the division walls 7, prevent the casing 10 from swelling toward outside and deforming, and have an effect of improving the contrast.

Although this embodiment is a case where the bonding members 15 are formed on the inner surface of the upper panel substrate 4, the bonding members 15 may also be formed on the ridges of the division walls 7 formed on the lower panel substrate 8 without any problem, while proving more effective in achieving more reliable bonding because sufficient amount of the bonding member is formed in the bonding area.

Of course the contrast of the PDP can be improved further by making the bonding members 15 shown in FIG. 13 and FIG. 14 of a light absorbing material.

A PDP according to another variation of the bonding members 15 will be described below with reference to FIG. 15. While the bonding members 15 described above are provided on most part of the ridges of the division walls 7 for bonding with the upper panel substrate 4, bonding may not necessarily be done on most part and partial bonding shown in FIG. 15 is also effective.

The bonding has, as described repetitively above, in addition to the apparent effect of preventing the panel from swelling toward the outside and deforming, and effect of preventing cross talk from occurring between discharge cells by filing the gap between the ridges of the division walls and the upper panel substrate with the bonding member and completely separating the discharge cells.

While it can be freely determined where to bond or not to bond, it is more preferable to provide the bonding members 15 at and around the intersects of the ridges of the division walls and the display electrode 1. It is because larger discharge occurs at these points.

Figure 15:
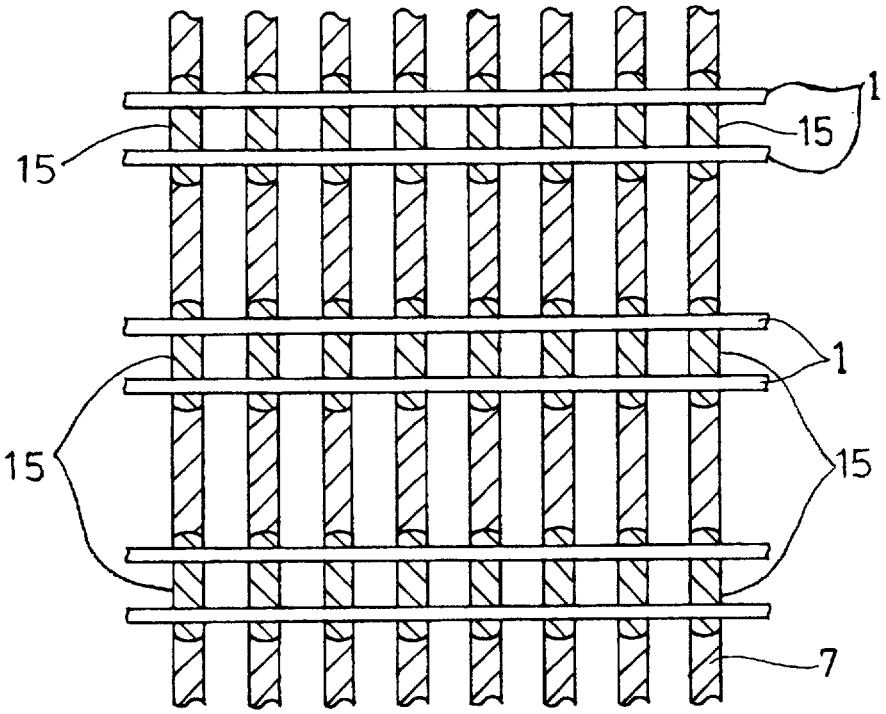
FIG. 15 is a plan view of another example related to the method of applying the bonding member.

While FIG. 15 shows a case of uniform bonding in the vicinity of the display electrode 1, bonding may not necessarily be uniform and may be provided only at portions where cross talk is likely to occur or may be done linearly on some part of the ridges of the division walls.

Figure 16:
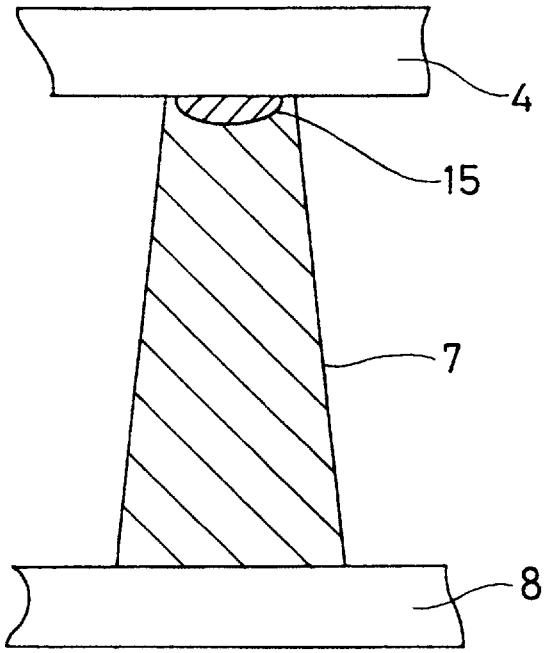
FIG. 16 is a plan view of another example related to the configuration of ridge of a division wall.

Now another embodiment will be described below with reference to FIG. 16. The PDP according to this embodiment has, similarly to the prior art, the casing of such a configuration as the upper panel substrate 4 with a plurality of display electrodes 1 formed thereon and the lower panel substrate 8 with a plurality of data electrodes 5 and the division walls formed on the inner surface thereof in a direction at right angles to the display electrodes 1 are disposed to oppose each other, and the peripheries of the panels are sealed by the bonding member 15 made of glass having a low melting point. The division walls 7 have grooves on the ridges thereof, while the grooves are filled with the bonding members 15 thereby to bond the upper panel substrate 4 and the division walls 7 via the bonding members 15. The division walls 7 are formed as follows. A resin coat layer is formed by laminating a dry resist film on the lower panel substrate 8 and, after selective exposure by using an exposure mask, a negative pattern is made by development process. An opening of the pattern is filled with a paste by squeezing or the like to the same height as the surface of the resin coat layer. Then the lower panel substrate 8 is dried to remove the solvent included in the paste, upon which the paste is recessed at the middle. This recessed shape can be adjusted by controlling the amount of the solvent included in the paste, the amount of the filler or the opening configuration of the resin coat layer. Alternatively, the recessed shape can be made by machining the ridges of the division walls 7 by mechanical means, irradiating with laser light or the like. When the recesses on the division walls 7 formed as described above is filled with the bonding members 15, bonding area between the division walls 7 and the bonding members 15 increases leading to increased bonding strength and also increases the apparent area of light emitting due to decreased projection of the bonding members 15 beyond the width of the division walls.

Now a method for manufacturing the PDP according to this embodiment will be described below following the order of procedure.

First, the upper panel substrate 4 with the display electrodes 11 the dielectric layer 2 and the protective layer 3 formed thereon and the lower panel substrate 8 with the data electrodes 5, the dielectric layer 6 and the division walls 7 formed and the fluorescent substance 11 applied thereon are prepared, and the bonding member 15 made of a material having a low melting point such as frit glass are provided on the ridges of the division walls 7.

While screen printing or transfer by means of a stamper is employed for providing the bonding members 15, they can also be applied by lift-off or the like. Or, alternatively, the bonding members 15 may also be provided by forming frit glass layers on the ridges of the division walls 7. Such a method may also be employed as frit glass that would become the bonding members 15 is applied to predetermined portions of the upper panel substrate 4 that correspond to the division walls 7 provided on the lower panel substrate 8.

In screen printing, it is common to form in advance a pattern through which an adhesive material of predetermined viscosity passes for the screen that makes contact with the ridges of the division walls 7. However, the bonding members 15 may also be provided only on the ridges of the division walls 7 by screen printing, after making a screen through the entire surface of which the adhesive material can pass.

Then the upper panel substrate 4 and the lower panel substrate 8 are disposed to oppose each other via the division walls 7 having the bonding members formed thereon as described above, and the sealing member 9 is interposed between the peripheries of the two panel substrates 4, 8.

In this case, when the panel substrates are heated while applying pressure from the outer surface toward the inner surface, as shown in FIG. 17, the upper panel substrate 4 and the lower panel substrate 8 are sealed on the peripheries thereof by the sealing member 9. At the same time, the upper panel substrate 4 and the lower panel substrate 8 are bonded to each other by the bonding members 15 which have been melted by the heat in the display area at the center, thereby forming the casing 10.

Further, the lower panel substrate 8 is fitted on an external position thereof with the piping member 13 that communicates with the casing 10 via the through hole 8a formed on the lower panel substrate 8 that constitutes the casing 10. Then after purging the air from the inside of the casing 10 and filling the inner space with the discharge gas the piping member 13, the piping member 13 is closed thereby sealing the inner space of the casing 10, thus completing the PDP shown in FIG. 6.

Pressurization when bonding the upper panel substrate 4and the lower panel substrate 8 is carried out, for example, by the method shown in FIG. 18.

First, the upper panel substrate 4 and the lower panel substrate 8 that constitute the casing 10 are tentatively secured at predetermined positional relationship and placed on a flat base 16.

Then a plurality of pressurizing jigs 23 are placed at predetermined positions. The pressurizing jig 23 comprises a spring receiver A (20), a spring receiver B (22), a spring 21 and a bolt 19, while the spring receiver A (20) and the spring receiver B (22) are separated with the spring 21 interposed therebetween.

Pressurizing force of the spring 21 can be controlled by adjusting the position of the spring receiver B (22) by means of the bolt 19. The pressurizing jig 23 is inserted between the casing 10 and a frame 18 that is secured on the base 16 via supports 17, while adjusting the position of the spring receiver B (22) by means of the bolt 19 so that the total length of the pressurizing jig 23 becomes greater than the distance. Since the spring 21 is installed while being compressed, pressure is applied to the two panel substrates.

Frit glass that makes the bonding members 15 and the sealing member 9 is normally used while being heated to 45° C. and melted, and the spring 21 used herein is of course made of a material that does not lose resilience at 450° C. For example, Inconel is used.

Now a variation of the method of pressurization will be described below with reference to FIG. 19.

First, it is the same as the embodiment described above that the upper panel substrate 4 and the lower panel substrate 8 that constitute the casing 10 are tentatively secured in predetermined positional relationship and placed on the flat base 16. Then a shock absorber 24 made of a resilient material that does not change the characteristics thereof when heated to 450° C. is placed to cover the entire surface of the casing 10. For the shock absorber 24, steel wool or the like can be used.

Then a plate 25 having a predetermined weight, uniform thickness and a size that covers the entire surface of the casing is placed on the shock absorber 24 that is placed on the casing 10. It is necessary to interposed the shock absorber 24 between the plate 25 and the casing 10, because a foreign matter interposed therebetween may generate uneven gap between the upper panel substrate 4 and the lower panel substrate 8 that constitute the casing 10 due to partially changed pressure and, in case the foreign matter is large, localized force may be applied eventually leading to breakage of the casing 10.

As described above, the gas discharge panel according to the present invention has such an advantage that, because the upper panel substrate and the lower panel substrate that constitute the casing are bonded to each other via the bonding members, problems of gap being generated between the division walls and the panel substrate and the casing swelling toward the outside to deform never occur, even when the casing is filled with the discharge gas with a pressure exceeding 500 torr.

In addition, deterioration in the characteristics of the panel does not occur since the bonding member does not come out of the width of the division walls or, should it come out, it is made of a transparent material. Also forming the bonding members in a direction at right angles to the division walls has an effect of separating the pixels that adjoin each other in the direction of the division walls, thereby improving the contrast.

The method for manufacturing the gas discharge panel according to the present invention has such an advantage that the division walls and the opposing panel substrate can be bonded uniformly over the entire area of the casing, and therefore the gas discharge panel of improved brightness can be easily manufactured.

While the PDP in the embodiments described above has the dielectric film, the invention is not limited to this configuration and a configuration without dielectric film may also be employed.

While the gas discharge panel in the embodiments described above is PDP of AC type, the gas discharge panel is not limited to PDP of AC type and the present invention may also be applied to PDP of DC type, as a matter of course.

The first panel substrate and the second panel substrate of the present invention correspond respectively to the front panel substrate and the back panel substrate in the embodiments described above. However, the present invention is not limited to this arrangement and may be embodied in such an arrangement as the first panel substrate corresponds to the back panel substrate and the second panel substrate corresponds to the front panel substrate. In this case, bases of the division walls rest on the inner surface of the front panel substrate and ridges of the division walls rest on the inner surface of the back panel substrate.

While the embodiments described above employ the bonding members, the present invention is not limited to this configuration and may be embodied in configurations that do not use bonding members in the examples shown in FIG. 5 and FIG. 8 through FIG. 9. A variation of the example shown in FIG. 5 is a method for manufacturing the gas discharge panel comprising the first panel substrate having the first electrode, the second panel substrate having the second electrode opposing the first panel substrate, the sealing portion provided between the peripheries of the two substrates for forming the gas discharge space between the first and second panel substrates and division walls provided on the second panel substrate to divide the gas discharge space, wherein the manufacturing method comprises a process of exposing a photosensitive material provided on the second panel substrate thereby to form grooves, and a thermal spray process for filling the grooves formed in the foregoing process with a dielectric material or frit glass thereby forming the division walls, while coolant gas is caused to flow along the material ejected from a thermal spray nozzle to cool down the second panel substrate. According to this manufacturing method, the gas discharge panel preferably has a dielectric film that covers the second electrode with the dielectric film and the division walls being made of alumina. This configuration also achieves effects similar to those described above. A variation of the example shown in FIG. 8 and FIG. 9 is a method for manufacturing the gas discharge panel comprising the first panel substrate having the first electrode, the second panel substrate having the second electrode opposing the first panel substrate, the sealing portion provided between the peripheries of the two substrates for forming the gas discharge space between the first and second panel substrates and division walls provided on the second panel substrate to divide the gas discharge space, wherein the manufacturing method comprises an assembly process of assembling the first panel substrate and the second panel substrate into the gas discharge panel by means of the sealing portion, a process of attaching the piping member that communicates with the gas discharge space via a through hole formed in the first or the second panel substrate onto the panel substrate that has the through hole, a sealing process of filling the gas discharge space with the discharge gas by using the piping member and a sealing process of closing the piping member. This has an effect of being capable of providing a manufacturing method different from the prior art.

Industrial Utilization

As will be clear from the description give so far, the present invention provides a gas discharge panel capable of producing more stable image with less possibility of cross talk than the prior art, and a method for manufacturing the same.

The present invention also provides a method for manufacturing the gas discharge panel that is capable of reducing the number of firing processes over the prior art.

The present invention also provides a method for manufacturing the gas discharge panel that is capable of increasing the bright over the prior art.

What is claimed is:

1. A gas discharge panel comprising:

a first panel substrate;

a second panel substrate opposing said first panel substrate;

a sealing portion provided between peripheries of the two substrates for forming a gas discharge space between said first and second panel substrates; and division walls provided on said second panel substrate for dividing said gas discharge space, wherein ridges of said division walls are bonded onto the inner surface of said first panel substrate via bonding members, and said gas discharge space is filled with a discharge gas with a pressure exceeding 760 Torr.

2. A gas discharge panel as claimed in claim 1 wherein the bonding member used in the bonding process includes a light-transmitting material.

3. A gas discharge panel as claimed in claim 1 wherein the bonding member used in the bonding process includes a light-absorbing material, and the material for making said division wall includes a light-reflecting material.

4. A gas discharge panel as claimed in claim 1, 2 or 3 wherein the width of bonding portion between the ridge of said division wall and said first panel substrate is controlled so that the bonding portion does not intrude into a light emitting region in the divided gas discharge space.

5. A gas discharge panel as claimed in claim 1 wherein the bonding member used in the bonding process includes fusible glass.

6. A gas discharge panel as claimed in claim 1 wherein the softening point of said bonding member is lower than the softening point of said division walls.

7. A gas discharge panel as claimed in claim 6 wherein difference in the softening point of said bonding member and said division walls is not lower than 20° C. and not higher than 200° C.

8. A gas discharge panel as claimed in claim 5 wherein said division walls have holes on the ridges thereof and said bonding members infiltrates the holes.

9. A gas discharge panel as claimed in claim 5 or 8 wherein said division walls are formed by thermal spray process.

10. A gas discharge panel as claimed in claim 1 or 5 wherein at least one of the ridge surface of said division walls and portions of the inner surface of said first panel substrate bonded to the ridges has irregular shape.

11. A gas discharge panel as claimed in claim 1 wherein all or a part of the ridges of said division walls are bonded onto the inner surface of said first panel substrate.

12. A gas discharge panel as claimed in claim 11 wherein said division walls are a plurality of long plate-shaped ribs disposed in parallel to each other, and the bonding is achieved by using bonding members formed linearly in a direction substantially at right angles with the longitudinal direction of said ribs.

13. A gas discharge panel as claimed in claim 12 wherein said bonding member includes a light-absorbing material.

14. A gas discharge panel as claimed in claim 11, 12 or 13 wherein notation that part of the ridges of said division walls are bonded onto the inner surface of said first panel substrate means that said bonding is provided in the vicinity of said first electrode in the ridges of said division walls.

15. A gas discharge panel as claimed in claim 1 wherein the ridges of said division walls have recesses formed thereon, and said bonding is achieved by using said recesses.

16. A gas discharge panel as claimed in claim 1 wherein said division walls and said second panel substrate are bonded by using frit glass.

* * * * *